US011622628B2

(12) United States Patent
Kressin et al.

(10) Patent No.: US 11,622,628 B2
(45) Date of Patent: Apr. 11, 2023

(54) WALL HANGING SYSTEM

(71) Applicant: MCS Industries, Inc., Easton, PA (US)

(72) Inventors: Matthew Scott Kressin, Allentown, PA (US); Changhong Huang, Nanjing (CN)

(73) Assignee: MCS Industries, Inc.

( * ) Notice: Subject to any disclaimer, the term of this patent is extended or adjusted under 35 U.S.C. 154(b) by 0 days.

(21) Appl. No.: 17/218,970

(22) Filed: Mar. 31, 2021

(65) Prior Publication Data

US 2022/0312964 A1 Oct. 6, 2022

(51) Int. Cl.

| | |
|---|---|
| ***A47B 96/06*** | (2006.01) |
| ***A47B 95/00*** | (2006.01) |
| ***A47B 5/02*** | (2006.01) |
| ***A47F 5/08*** | (2006.01) |
| ***A47B 96/02*** | (2006.01) |

(52) U.S. Cl.

CPC ..... *A47B 96/066* (2013.01); *A47B 5/02* (2013.01); *A47B 95/008* (2013.01); *A47B 96/028* (2013.01); *A47B 96/061* (2013.01); *A47B 96/068* (2013.01); *A47F 5/0853* (2013.01)

(58) Field of Classification Search

CPC ..... A47B 95/008; A47B 5/00; A47B 5/02; A47B 97/001; A47B 96/028; A47B 96/022; A47B 96/024; A47B 96/066; A47B 96/068; A47B 96/061; A47B 96/02; A47B 2220/0041; A47B 2220/0036; A47F 5/0853; A47F 5/0876; F16M 13/005

USPC ..... 108/42, 152; 248/475.1, 477, 223.41, 248/224.51, 231.91

See application file for complete search history.

(56) References Cited

U.S. PATENT DOCUMENTS

| | | | | |
|---|---|---|---|---|
| 4,711,419 A | | 12/1987 | Polosky | |
| 4,930,742 A | * | 6/1990 | Schofield | B60R 1/04 248/225.11 |
| 5,110,080 A | | 5/1992 | Rieman | |
| 5,433,416 A | * | 7/1995 | Johnson | B65D 23/003 248/475.1 |

(Continued)

FOREIGN PATENT DOCUMENTS

| | | | | |
|---|---|---|---|---|
| CH | 684432 A5 | * | 9/1994 | F16B 12/10 |
| DE | 202018101491 U1 | * | 7/2019 | F16M 13/02 |

(Continued)

*Primary Examiner* — Andrew M Roersma
(74) *Attorney, Agent, or Firm* — Belles Katz LLC

(57) ABSTRACT

A wall hanging system by which a wall décor item such as a ledge, a frame, a mantel, or the like may be mounted to and hung from a wall. The wall hanging system may include the wall décor item having a rear surface and first and second mounting channels in the rear surface. The wall hanging system may also include first and second mounting brackets that are configured to be mounted to the wall. At least one of the first and second mounting brackets may have an elongated aperture through which a fastener extends for mounting that mounting bracket to the wall. As such, the mounting bracket with the elongated aperture is able to slide side-to-side along the wall while being mounted to the wall in order to properly align the first and second mounting brackets with the first and second mounting channels of the wall décor item.

20 Claims, 20 Drawing Sheets

(56) References Cited

U.S. PATENT DOCUMENTS

| | | | | |
|---|---|---|---|---|
| 5,474,395 | A * | 12/1995 | Miki | A47B 96/066 108/158 |
| 6,561,474 | B1 | 5/2003 | Walter | |
| 8,082,859 | B2 * | 12/2011 | Sevack | A47B 96/066 248/250 |
| 8,430,252 | B2 | 4/2013 | Susan | |
| 8,684,195 | B1 | 4/2014 | Caruso | |
| D732,927 | S | 6/2015 | Booth | |
| 9,185,979 | B1 * | 11/2015 | Jenks | A47B 96/066 |
| D789,774 | S | 6/2017 | Turk | |
| 10,206,506 | B1 * | 2/2019 | Lai | A47B 96/1433 |
| 10,602,843 | B2 | 3/2020 | Sisto | |
| 2006/0243688 | A1 | 11/2006 | Gilcrest | |
| 2009/0294623 | A1 * | 12/2009 | Pinchuk | F16B 25/10 248/546 |
| 2018/0140086 | A1 * | 5/2018 | Witzel | A47B 5/04 |
| 2018/0213932 | A1 | 8/2018 | Reimers | |
| 2019/0320825 | A1 | 10/2019 | Coyle, Jr. | |
| 2020/0337460 | A1 * | 10/2020 | Sylvester | H02J 13/00026 |

FOREIGN PATENT DOCUMENTS

| | | | | |
|---|---|---|---|---|
| EP | 2886012 | A2 * | 6/2015 | A47B 96/066 |
| GB | 1077792 | A * | 8/1967 | A47B 96/061 |
| GB | 2013080 | | 8/1979 | |
| GB | 2252717 | | 8/1992 | |
| KR | 100615129 | | 8/2006 | |
| WO | WO-2004062430 | A1 * | 7/2004 | A47B 96/061 |

* cited by examiner

WALL HANGING SYSTEM

BACKGROUND OF THE INVENTION

There are many instances in which people desire to hang an article from a wall. For example, people enjoy hanging artwork and other decorations from a wall in a home to personalize the space. People also hang artifacts and diplomas and other achievement indicators from the walls in their offices. Moreover, people hang shelves and other ledges from the wall to display items thereon. However, for many people the process of hanging articles from the wall is a daunting and stressful experience. There are currently several ways that such items, and specifically ledges and similar-type items, are hung from a wall. Specifically, ledges and the like may be hung from a wall using French cleats, floating shelf brackets with protruding rods that nest within holes in the item, and keyways. French cleats and floating shelf brackets have high material costs and some difficulty in manufacturing. Keyways are the most common, but users must be very exact in their placement of screws in the wall to ensure that the multiple keyways align with the multiple screws simultaneously, which can be very frustrating for the everyday consumer. Thus, a need exists for a simpler way to effectively hang various articles from a wall which allows for some tolerance and a less exacting screw placement.

SUMMARY OF THE INVENTION

The present invention is directed to a wall hanging system by which a wall décor item such as a ledge, a frame, a mantel, or the like may be mounted to and hung from a wall. The wall hanging system may include the wall décor item having a rear surface and first and second mounting channels in the rear surface. The wall hanging system may also include first and second mounting brackets that are configured to be mounted to the wall. At least one of the first and second mounting brackets may have an elongated aperture through which a fastener extends for mounting that mounting bracket to the wall. As such, the mounting bracket with the elongated aperture is able to slide side-to-side along the wall while being mounted to the wall in order to properly align the first and second mounting brackets with the first and second mounting channels of the wall décor item. Once properly aligned, the wall décor item can be mounted to the wall by nesting the first and second mounting brackets within the first and second mounting channels, respectively.

In one aspect, the invention may be a wall hanging system comprising: a wall décor item comprising a rear surface that is configured to face a wall when the wall décor item is mounted to the wall, a first mounting channel and a second mounting channel formed into the rear surface of the wall décor item in a spaced apart manner; a first mounting bracket comprising a front surface, a rear surface, and a first mounting aperture extending from the front surface to the rear surface, the first mounting aperture being configured to receive a first fastener for mounting the first mounting bracket to the wall; a second mounting bracket comprising a front surface, a rear surface, and a second mounting aperture extending from the front surface to the rear surface, the second mounting aperture being configured to receive a second fastener for mounting the second mounting bracket to the wall; wherein at least one of the first and second mounting apertures is elongated so that at least one of the first and second mounting brackets is configured to slide side-to-side along the wall when mounted to the wall; and wherein at least a portion of the first mounting bracket nests within the first mounting channel and at least a portion of the second mounting bracket nests within the second mounting channel to mount the wall décor item to the wall.

In another aspect, the invention may be a wall hanging system comprising: a wall décor item comprising a first side edge, a second side edge, a rear surface, and a mounting channel formed into the rear surface and set inwardly from each of the first and second side edges; a mounting bracket comprising an elongated mounting aperture that is configured to receive a fastener for mounting the mounting bracket to a wall, the mounting bracket being configured to slide side-to-side along the wall relative to the fastener while remaining mounted to the wall; and wherein at least a portion of the mounting bracket nests within the mounting channel to mount the wall décor item to the wall.

In yet another aspect, the invention may be a method of hanging a wall décor item from a wall, the method comprising: positioning a rear surface of a first mounting bracket into abutment with the wall and inserting a first fastener through a first aperture in the first mounting bracket and into the wall to mount the first mounting bracket to the wall, wherein the first aperture of the first mounting bracket is elongated so that the first mounting bracket can move side-to-side along the wall while mounted to the wall by the first fastener; positioning a rear surface of a second mounting bracket into abutment with the wall at a distance from the first mounting bracket and inserting a second fastener through a second aperture in the second mounting bracket and into the wall to mount the second mounting bracket to the wall; positioning a rear surface of a wall décor item into contact with the wall with a first mounting channel of the wall décor item aligned with the first mounting bracket and a second mounting channel of the wall décor item aligned with the second mounting bracket; and sliding the wall décor item downwardly along the wall until the first mounting bracket nests within the first mounting channel and the second mounting bracket nests within the second mounting channel, thereby mounting the wall décor item to the wall.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
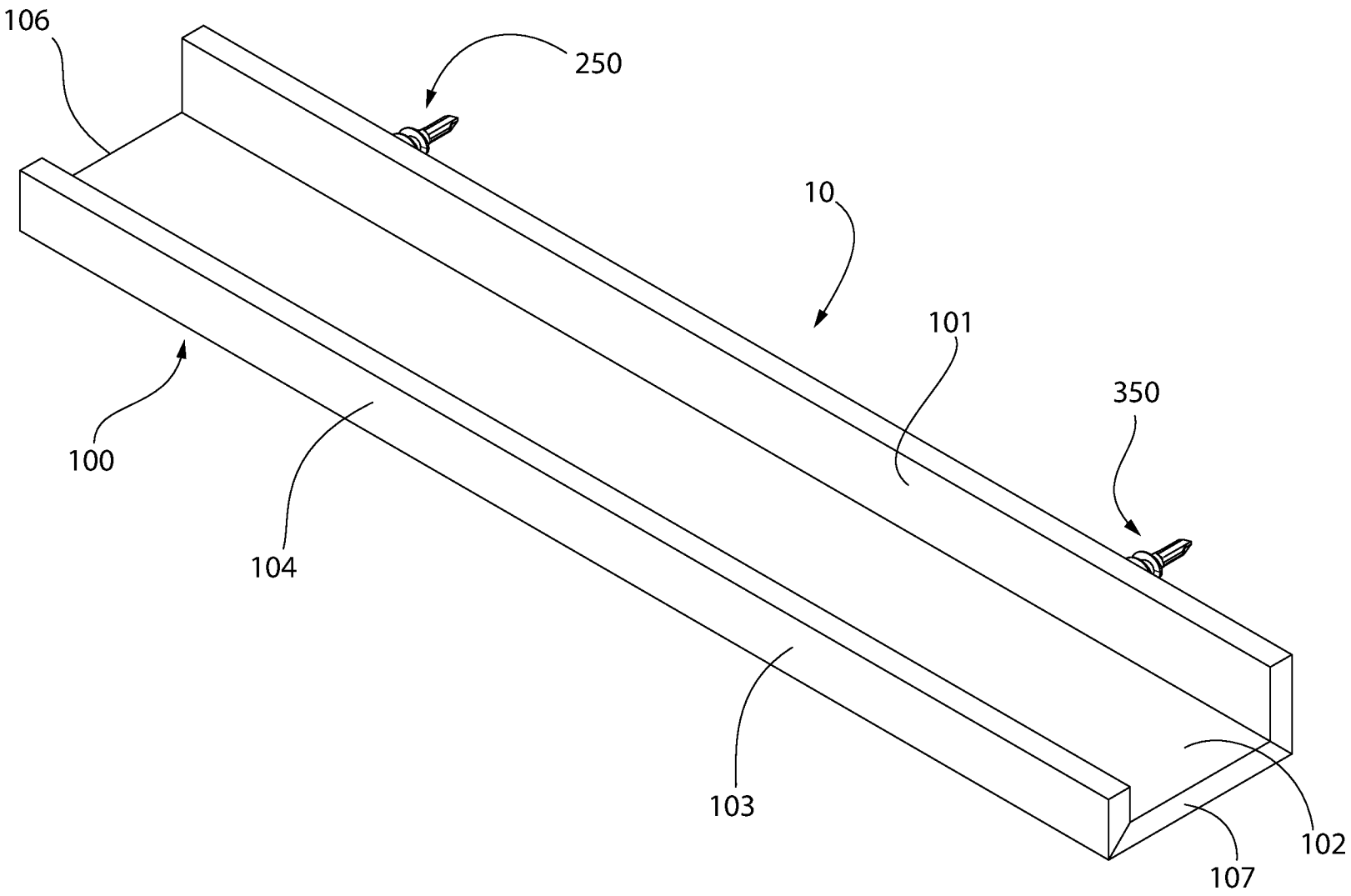
FIG. 1 is a front perspective view of a wall hanging system in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Referring to FIGS. 1-4, a wall hanging system 10 is illustrated in accordance with an embodiment of the present invention. The wall hanging system 10 generally comprises a wall décor item 100, a first mounting bracket 200, a second mounting bracket 300, a first fastener 250 for coupling the first mounting bracket 200 to a wall, and a second fastener 350 for mounting the second mounting bracket 300 to the wall. The wall décor item 100 is intended to be hung from a wall or other support surface by way of the first and second mounting brackets 200, 300, which are coupled directly to the wall via the first and second fasteners 250, 350, respectively. In particular, the first and second mounting brackets 200, 300 are first mounted to the wall, and then the wall décor item 100 is brought into engagement with the first and second mounting brackets 200, 300 so that the wall décor item 100 is mounted to the first and second mounting brackets 200, 300 and thereby hung from the wall.

In the exemplified embodiment, the wall décor item 100 is a ledge or shelf. However, the invention is not to be so limited in all embodiments and the wall décor item 100 may be any item that a user desires to hang from a wall or other vertical or semi-vertical surface. Thus, for example, the wall décor item 100 may be a mantel, a frame, an artifact, a canvas, a photograph, a drawing, a mirror, an artistic work, a cabinet, a bookshelf, a chalkboard, a whiteboard, a case, a hook, a set of hooks on a common base, a hat rack, a coat rack, or the like. An example of the wall décor item being a cabinet is shown in FIGS. 17-20, which will be discussed in detail below. In some embodiments, the wall décor item 100 comprises a ledge or a shelf. For example, the wall décor item 100 may be a mantel or a set of hooks which includes a ledge/shelf.

The features of the wall décor item 100 that are used for mounting the wall décor item 100 to the first and second mounting brackets 200, 300 can be readily incorporated into articles or items other than ledges. Moreover, although the invention is described herein with reference to hanging the wall décor item 100 from a wall, the wall could be any supporting structure, such as a cabinet (with or without doors), a bookshelf, a dresser, or the like on which the wall décor item 100 may be mounted. Thus, as used herein the term wall is not intended to be limited to a drywall or plasterboard, but would be an article that itself is mounted to a wall or a stand-alone article such as a cabinet or bookshelf to which the wall hanging system 10 may be mounted. In some embodiments, the wall décor item 100 may be described as being hung from or mounted to a support surface, which may include walls, cabinets, bookshelves, dressers, towel rack cabinets, desks, or the like.

Referring to the exemplified embodiment shown in FIGS. 1-4, the wall décor item 100 is a ledge or shelf. In that regard, the wall décor item 100 comprises a back panel 101, a bottom support panel 102, and a front panel 103. Of course, it may be possible in some embodiments to omit the back panel 101 and the front panel 103 so that the wall décor item 100 consists only of the bottom support panel 102. In the exemplified embodiment, the wall décor item 100 is intended to be hung from a wall with the back panel 101 facing the wall and with an upper surface of the bottom support panel 102 protruding horizontally from the wall so that items can be stored or displayed thereon. The front panel 103 extends upwardly from the upper surface of the bottom support panel 102 to prevent items or articles stored or displayed on the bottom support panel 102 from readily sliding or falling off.

The wall décor item 100 of the exemplified embodiment, which is a ledge, may be made from any of a variety of different materials and may come in a variety of different designs, shapes, and sizes That is, the wall décor item 100 may be made from wood, plastic, metal, or other materials, including combinations of materials. The wall décor item 100 could be rectangular as shown, or it could have other shapes such as triangular (as a corner ledge) or the like. Moreover, the back panel 101 of the wall décor item 100 could extend downwardly below a lower surface of the bottom support panel 102, and hooks may be affixed to a front surface of the back panel 101 at a location below the bottom support panel 102 for purposes of hanging items thereon (i.e., the ledge could be a functional ledge with hooks).

The wall décor item 100 of the present invention may be formed from a variety of materials, including medium-density fiberboard (MDF), any of a variety of species and types of wood, particle board, and plastic. When formed from plastic, the parts of the wall décor item 100 may be injection molded or extruded from polyvinyl chloride or other thermoplastic materials or the like. The wall décor item 100 may be solid or hollow. Where the wall décor item 100 includes several parts that are attached together such as the back panel 101, the bottom support panel 102, and the front panel 103 as shown in the exemplified embodiment, the parts may be coupled together using one or both of adhesives and brad nails. The various components may be affixed with miter joints, butt joints, or any other type of joint. The wall décor items 100 described herein may be finished with paint, veneer, paper wrap, foils, or colorant for plastics.

As noted above, while the wall décor item 100 shown in the exemplified embodiment is a ledge for supporting and displaying items thereon, the invention is not to be so limited in all embodiments. The wall décor item 100 could be a cabinet that is hung from a wall. The wall décor item 100 could be a frame that is hung from a wall. The wall décor item 100 could be a mantel that is placed above a fireplace, and the wall décor item 100 may take other forms, some examples of which have been provided herein above. The techniques described herein can be applied to virtually any article or item that is intended to be hung from a wall to allow for easier hang ability and flexibility for consumers during the hanging process. The techniques described herein also provide additional benefits and advantages over the prior art mechanisms and systems used for hanging items, in particular ledges and the like, from walls.

The wall décor item 100 of the present invention comprises a front surface 104, a rear surface 105, a first side edge 106 extending between the front and rear surfaces 104, 105, and a second side edge 107 extending between the front and rear surfaces 104, 105. In the exemplified embodiment, the wall décor item 100 is a ledge and it is elongated between the first and second side edges 106, 107. Of course, since the wall décor item 100 can take on many different shapes, structures, and forms, it need not be elongated in this manner in all embodiments. The rear surface 105 of the wall décor item 100 is the surface that faces the wall when the wall décor item 100 is hung therefrom or mounted thereto. The front surface 104 of the wall décor item 100 then faces outward away from the wall and is exposed to people in the room in which the wall décor item 100 is hung.

Figure 3:
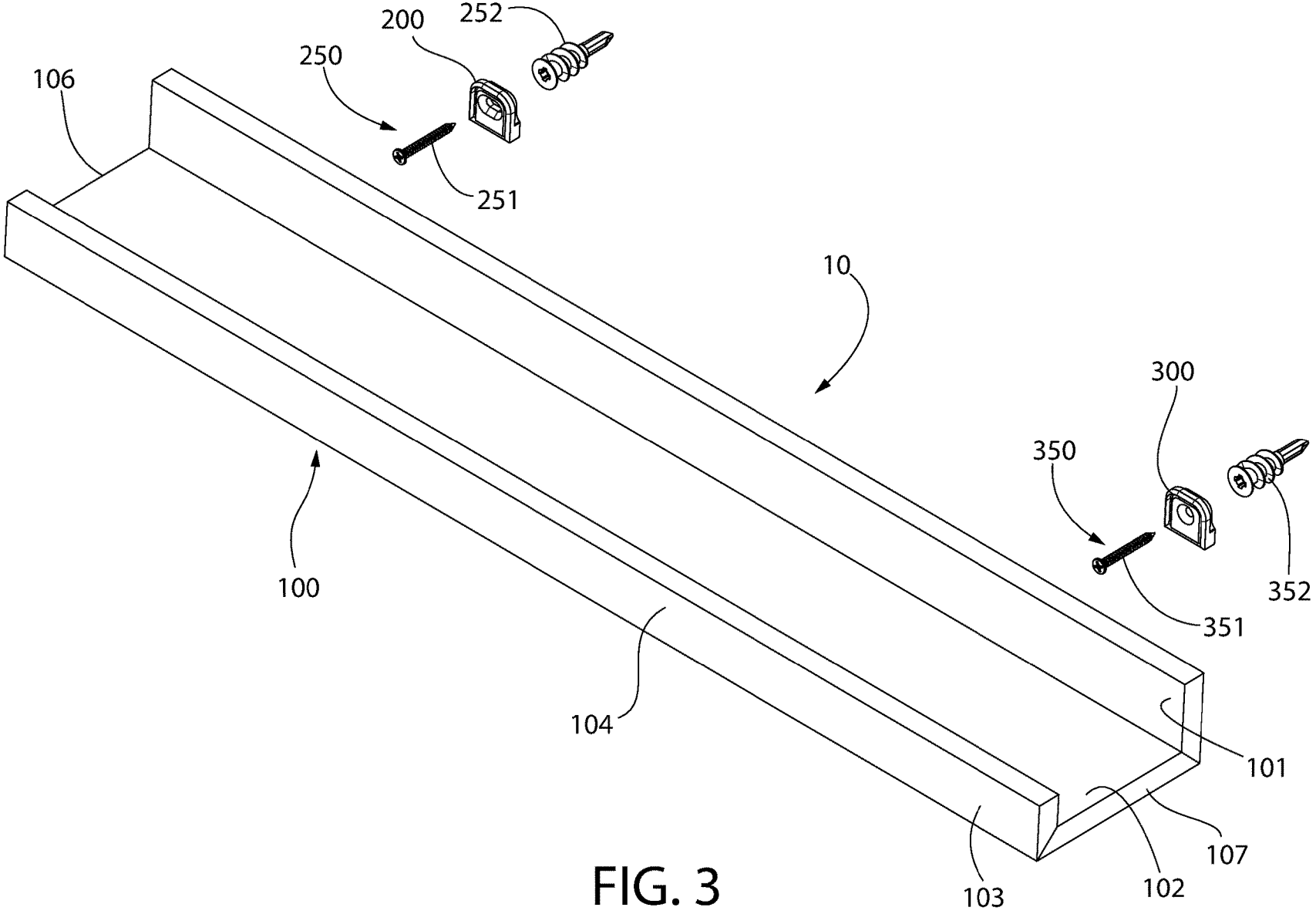
FIG. 3 is an exploded front perspective view of the wall hanging system of FIG. 1.
Figure 4:
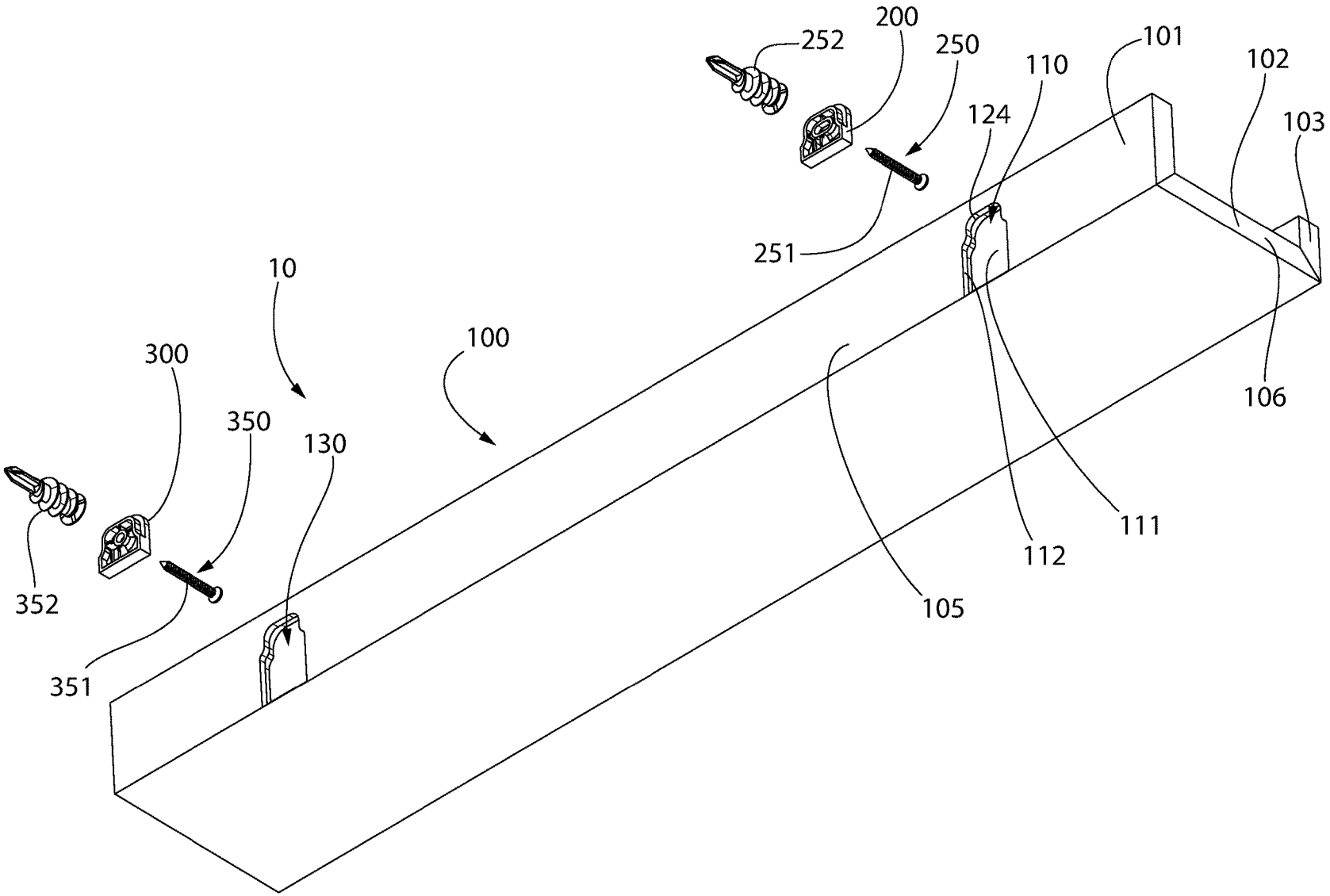
FIG. 4 is an exploded rear perspective view of the wall hanging system of FIG. 1.

In the exemplified embodiment, the wall décor item 100 comprises a first mounting channel 110 formed into the rear surface 105 and a second mounting channel 130 formed into the rear surface 105. In the exemplified embodiment, the first and second mounting channels 110, 130 are identical in all respects. Thus, the first and second mounting channels 110, 130 are each configured to receive a mounting bracket of the same type. However, this is not required in all embodiments and the first and second mounting channels 110, 130 could differ from one another in one or more characteristics such that each is configured to receive a different style, shape, or type of mounting bracket. Moreover, the first and second mounting brackets 200, 300 can be identical, and/or may differ from one another in at least one characteristic. In particular, as best seen in FIGS. 3 and 4, in the exemplified embodiment the first and second mounting brackets 200, 300 have differently shaped mounting apertures (the mounting bracket 200 has a slot-like opening that is elongated and the mounting bracket 300 has a hole-like opening that is not elongated). However, in other embodiments the first and second mounting brackets 200, 300 may have the same aperture and be identical in all respects. The first and second mounting channels 110, 130 will be described in greater detail below with reference to FIGS. 4-6 and the first and second mounting brackets 200, 300 will be described in greater detail below with reference to FIGS. 7A-7C and 8A-8C, respectively.

Figure 2:
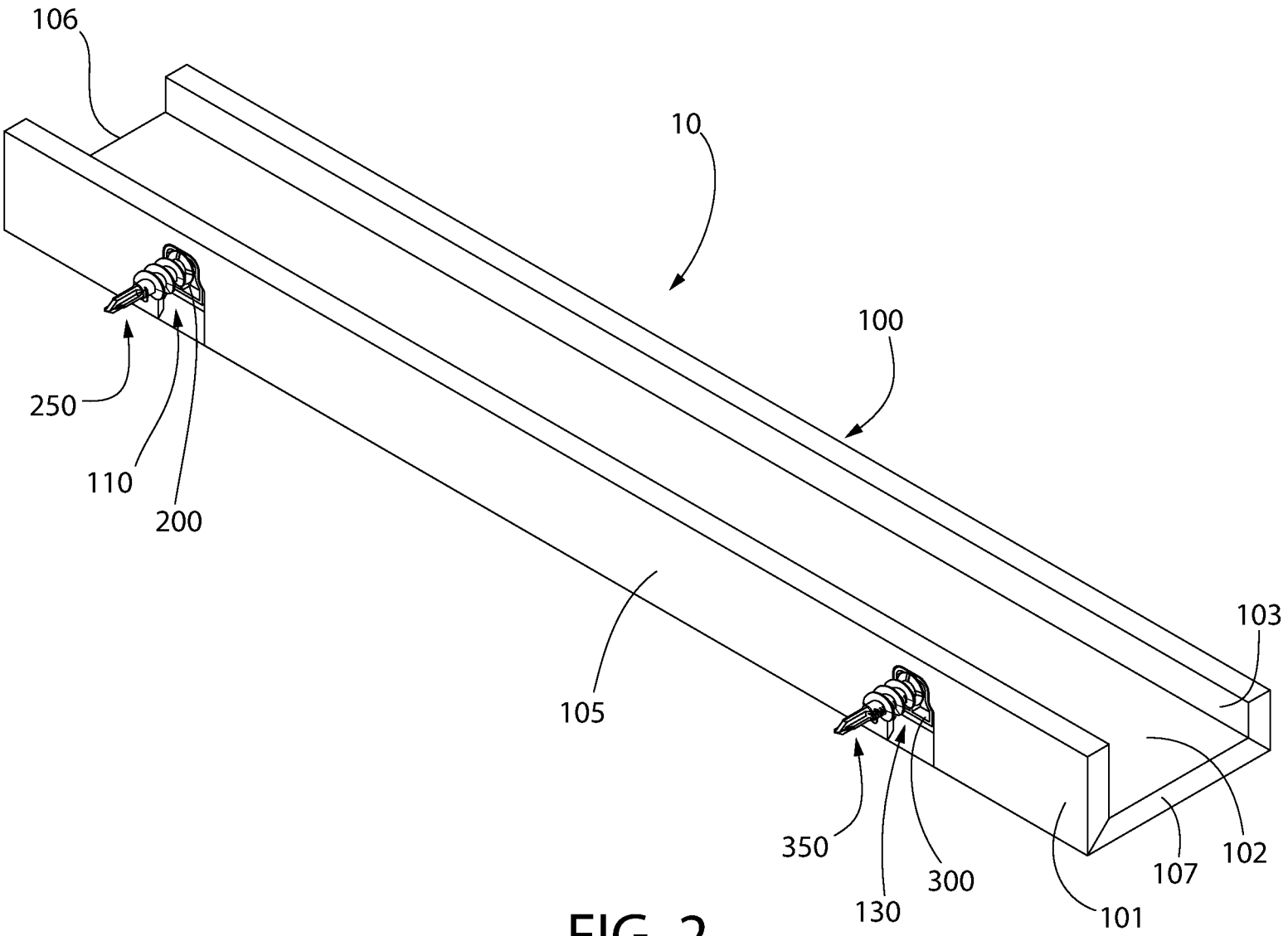
FIG. 2 is a rear perspective view of the wall hanging system of FIG. 1.

Still referring to FIGS. 1-4, as can be seen in particular in FIG. 2, the first and second mounting brackets 200, 300 are configured to be received within the first and second mounting channels 110, 130 of the wall décor item 100. Furthermore, the first and second mounting brackets 200, 300 are configured to be mounted to a wall via the first and second fasteners 250, 350, respectively. In the exemplified embodiment, the first fastener 250 comprises a first screw 251 and a first anchor 252 and the second fastener 350 comprises a second screw 351 and a second anchor 352. Of course, depending on the specific location at which the first and second mounting brackets 200, 300 are being mounted, the first and second anchors 252, 352 could be omitted. In particular, if the first and second mounting brackets 200, 300 are mounted to a wall within a stud, the first and second anchors 252, 352 may not be needed to provide sufficient support for the wall décor item 100. Moreover, the first and second fasteners 250, 350 may comprise nails or bolts or other similar types of hardware fasteners instead of screws (although screws are the most widely used fasteners for securing items that are intended to carry a load to a wall).

Figure 5:
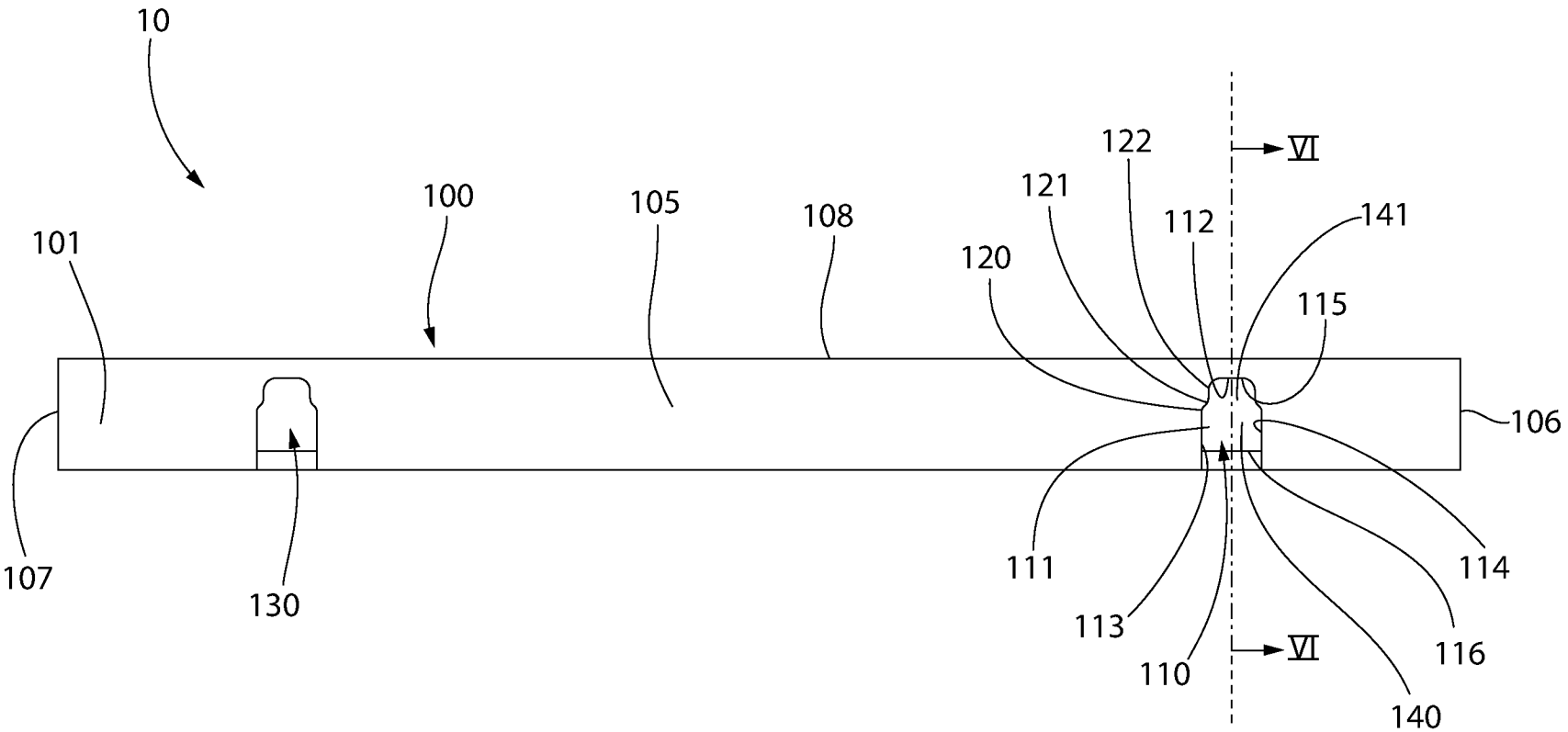
FIG. 5 is a rear view of a wall décor item of the wall hanging system of FIG. 1.
Figure 6:
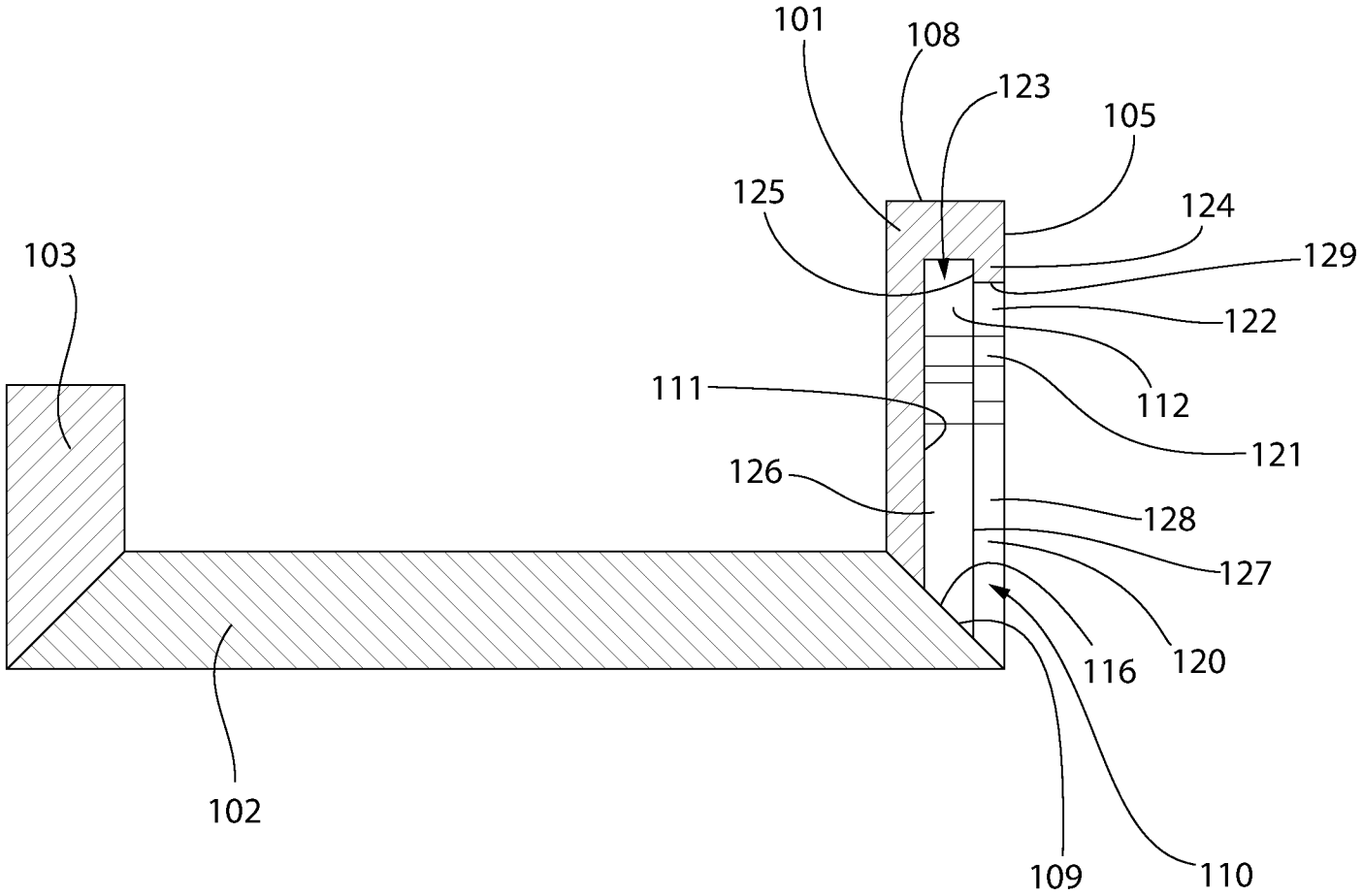
FIG. 6 is a cross-sectional view taken along line VI-VI of FIG. 5.

Referring now to FIGS. 4-6, the first and second mounting channels 110, 130 will be described in detail. In particular, the first mounting channel 110 will be described below in significant detail and the second mounting channel 130 will not. However, in the exemplified embodiment the second mounting channel 130 is entirely identical to the first mounting channel 110. Thus the description of the first mounting channel 110 is completely applicable to the second mounting channel 130 and a separate discussion of the second mounting channel 130 is not being provided herein in the interest of brevity. A person skilled in the art can rely on the discussion of the first mounting channel 110 for a detailed understanding of the second mounting channel 130.

Before going into a detailed discussion of the structure of the first mounting channel 110, it is noted that each of the first and second mounting channels 110, 130 is separate and distinct from the other. That is, the first mounting channel 110 is not in communication with the second mounting channel 130. Rather, the first and second mounting channels 110, 130 are two separate and distinct recesses that are formed into the rear surface 105 of the wall décor item 100. The first mounting channel 110 is entirely isolated from the second mounting channel 130. Furthermore, each of the first and second mounting channels 110, 130 is offset inwardly from the side edge 106, 107 of the wall décor item 100 to which it is closest. Specifically, the first mounting channel 110 is positioned closer to the first side edge 106 than to the second side edge 107, but the first mounting channel 110 does not extend all the way to the first side edge 106 but is instead spaced a distance from the first side edge 106 in the direction of the second side edge 107. Similarly, the second mounting channel 130 is positioned closer to the second side edge 107 than to the first side edge 106, but the second mounting channel 130 does not extend all the way to the second side edge 107 but is instead spaced a distance from the second side edge 107 in the direction of the first side edge 106. Thus, each of the first and second mounting channels 110, 130 is an isolated recess formed into the rear surface 105 of the wall décor item 100 which does not extend to the side edges 106, 107 of the wall décor item 100. The distance between the first mounting channel 110 and the first side edge 106 may be the same as the distance between the second mounting channel 130 and the second side edge 107. To be clear, there is no opening into the first or second mounting channels 110, 130 along the first or second side edges 106, 107 of the wall décor item 100.

While in the present invention the wall décor item 100 includes two of the mounting channels 110, 130, the invention is not to be so limited in all embodiments. Depending on the length of the wall décor item 100 and the weight it is configured to support, it may be desirable to include additional mounting channels 110, 130 to more securely affix the wall décor item 100 to the wall. Moreover, the wall décor item 100 may include extra mounting channels which may not be used for mounting the wall décor item 100 to the wall (i.e., they may be left empty instead of receiving a mounting bracket, depending on need). However, including such additional mounting channels may be useful as it would provide a consumer with the option to include additional mounting brackets if desired for the additional support. Moreover, for a small shelf/ledge or other item, it may be possible for the wall décor item 100 to have just a single mounting channel rather than two or more. With that said, two mounting channels 110, 130 is the most likely scenario regardless of the length of the wall décor item 100.

The first mounting channel 110 is a recess or cutout formed into the rear surface 105 of the wall décor item 100. The first mounting channel 110 extends along a first axis A-A which is normal to the length of the wall décor item 100 measured between the opposing side edges 106, 107. The first mounting channel 110 is defined by a floor 111 that is recessed relative to the rear surface 105 of the wall décor item 100 and a wall 112 that extends from the floor 111 to the rear surface 105 of the wall décor item 100. The wall 112 forms a peripheral boundary for the first mounting channel 110. In particular, the wall 112 forms a first side boundary 113 of the first mounting channel 110 located on a first side of the first axis A-A, a second side boundary 114 of the first mounting channel 110 located on a second side of the first axis A-A, and a top boundary 115 of the first mounting channel 110 that extends between the first and second side boundaries 113, 114. The top boundary 115 of the first mounting channel 110 is intersected by the first axis A-A of the first mounting channel 110 as seen in FIG. 5. The top boundary 115 formed by the wall 112 is spaced below a top edge 108 of the wall décor item 100 (the top edge 108 of the wall décor item 100 is the top edge of the back panel 101 of the wall décor item 100 in the exemplified embodiment). Thus, the wall 112 bounds the first mounting channel 110 on at least three sides, including both of the opposing lateral sides (the first and second side boundaries 113, 114). Specifically, because the first mounting channel 110 is set inwardly from the first and second side edges 106, 107 of the wall décor item 100, the first mounting channel 110 is bounded by the wall 112 and is not open on either of the first or second side edges 106, 107 of the wall décor item 100.

The wall 112 may also form a bottom boundary 116 of the first mounting channel 110 in some embodiments. However, in the exemplified embodiment the bottom boundary 116 of the first mounting channel 110 is formed by a mitered end 109 of the bottom support panel 102 of the wall décor item 100. That is, the first mounting channel 110 extends all the way to the bottom edge of the back panel 101, but when the back panel 101 is attached to the bottom support panel 102, the mitered end 109 of the bottom support panel 102 forms a lower boundary of the first mounting channel 110 (best shown in FIG. 6). In still other embodiments, the first mounting channel 110 may extend to the bottom end of the wall décor item 100 such that the first mounting channel 110 is not bounded along its bottom end. The details and variations set forth in this paragraph will not affect the functionality of the wall hanging system 10 and thus all are included in the invention described herein.

As shown in FIG. 5, the first mounting channel 110 comprises a very specific shape which matches or correlates to the shape of the first mounting bracket 200 so that the first mounting bracket 200 can nest within the first mounting channel 110 in a snug and tight fit manner. This prevents the wall décor item 100 from moving side-to-side along the wall when the wall décor item 100 is mounted to the wall via the first and second mounting brackets 200, 300. In that regard, the wall 112 which forms the peripheral boundary of the first mounting channel 110 comprises, on each side of the first axis A-A, a first vertical portion 120 that extends upwardly from the bottom boundary of the first mounting channel 110, an arcuate portion 121 which forms a downwardly facing shoulder, and a second vertical portion 122 that extends from the arcuate portion 121 to the top boundary 115. Of course, it should be appreciated that the exact shape of the first mounting channel 110 may be modified from the shape shown in the exemplified embodiment in many different ways without affecting the function of the invention as described herein.

As best seen in FIG. 6, the first mounting channel 110 comprises an undercut portion 123 which is positioned behind an overhang portion 124 of the wall décor item 100. The undercut portion 123 is a portion of the first mounting channel 110 that is adjacent to the floor 111 that has an increased cross-sectional area relative to the portion of the first mounting channel 110 that is adjacent to the rear surface 105 of the wall décor item 100. The overhang portion 124 comprises an inner surface 125 that faces the floor 111 of the first mounting channel 110, while the inner surface 125 of the overhang portion 124 is spaced apart from the floor 111 of the first mounting channel 110. The space between the inner surface 125 of the overhang portion 124 and the floor 110 of the first mounting channel 110 forms the undercut portion 124 of the first mounting channel 110.

In the exemplified embodiment, the wall 112 that forms the peripheral boundary of the first mounting channel 110 comprises a first wall portion 126 that extends from the floor 111 to a transition region 127 and a second wall portion 128 that extends from the transition region 127 to the rear surface 105 of the wall décor item 105. The first wall portion 126 bounds the undercut portion 123 of the first mounting channel 110 and the second wall portion 128 bounds the non-undercut portion of the first mounting channel 110. Thus, the first wall portion 126 is set inwardly relative to the second wall portion 128. The second wall portion 128 forms the overhang portion, and it terminates in an edge 129. The edge 129 comprises first and second arcuate portions on opposing sides of the first axis A-A of the first mounting channel 110 as best shown in FIG. 5.

The overhang portion 124 is cantilevered over the undercut portion 123 of the first mounting channel 110 so that the overhang portion 124 forms a locking feature that helps to securely attach the first mounting bracket 200 to the wall décor item 100 within the first mounting channel 110. As described in greater detail below, a portion of the first mounting bracket 200 nests within the undercut portion 123 of the first mounting channel 110 behind the overhang portion 124 so that the wall décor item 100 cannot be pulled away from the wall without first sliding the wall décor item 100 upwardly relative to the first mounting bracket 200 to remove the portion of the first mounting bracket 200 from the undercut portion 123 of the first mounting channel 110. The undercut portion 123 and the overhang portion 124 may extend along an entirety of the periphery of the first mounting channel 110 or only along a top region thereof.

It is worth reiterating that the second mounting channel 130 is identical to the first mounting channel 110 in all respects in accordance with the exemplified embodiment of the present invention. Thus, all of the features described above with reference to the first mounting channel 110 are applicable to the second mounting channel 130. Again, the second mounting channel 130 is not being described in detail here in the interest of brevity, it being understood that the description of the first mounting channel 110 is entirely applicable to the second mounting channel 130. That said, it could be possible to form the second mounting channel 130 with the same features, but a different shape, than the first mounting channel 110. However, this is not the preferred embodiment because it will unnecessarily complicate assembly and installation by a consumer, and the idea behind the invention described herein is to simplify installation of the wall décor item 100 on a wall to remove the frustrations that occur when a user attempts to mount a wall décor item to a wall using a keyway as is done currently.

Figure 7A:
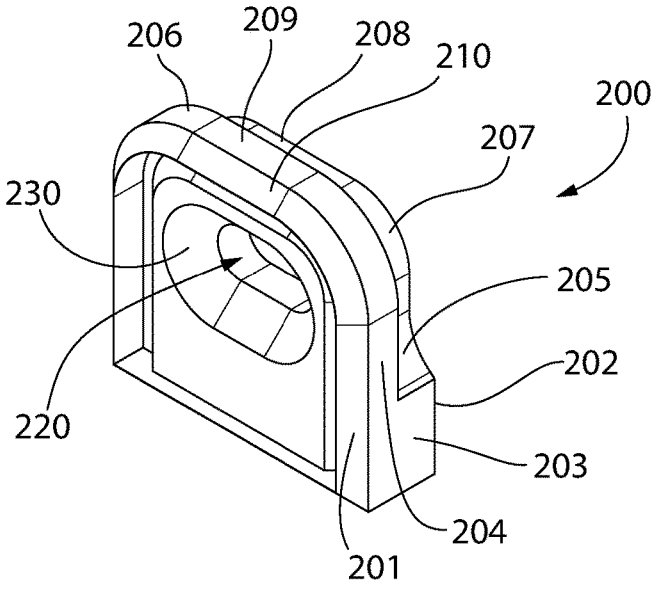
FIGS. 7A-7C are a front perspective, front, and rear perspective view of a mounting bracket of the wall hanging system of FIG. 1 in accordance with a first embodiment of the present invention.
Figure 7B:
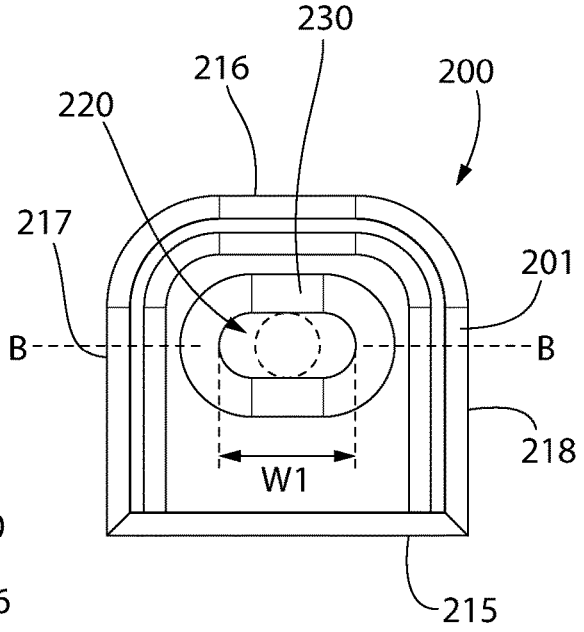
Figure 7C:
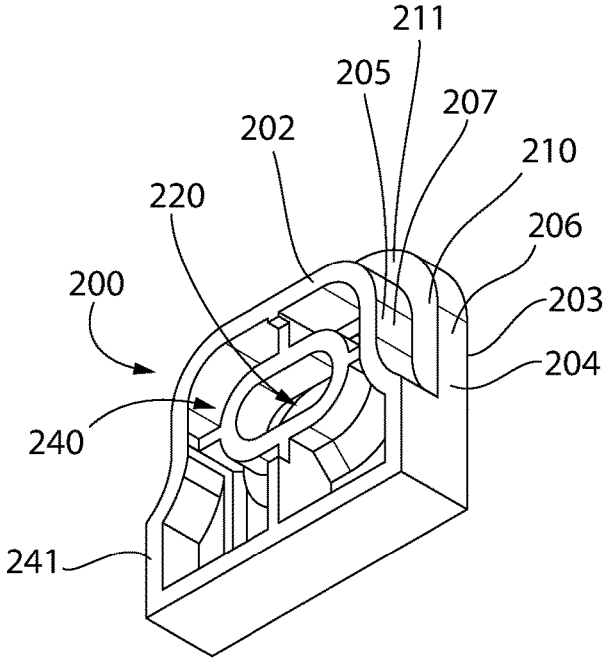
Figure 8A:
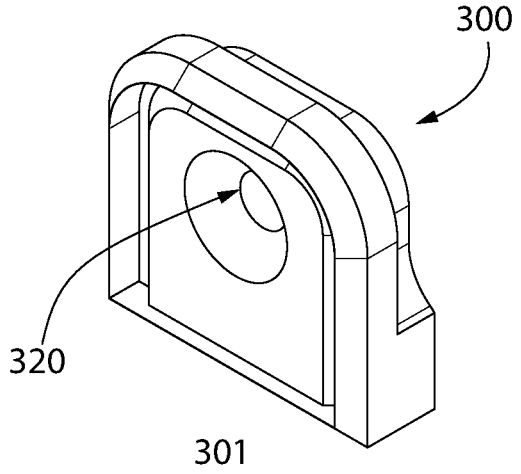
FIGS. 8A-8C are a front perspective, front, and rear perspective view of a mounting bracket of the wall hanging system of FIG. 1 in accordance with a second embodiment of the present invention.
Figure 8B:
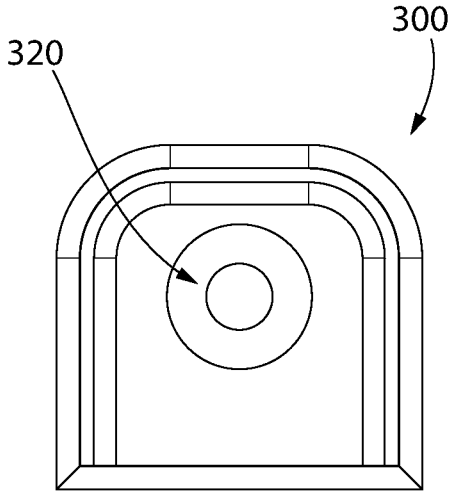
Figure 8C:
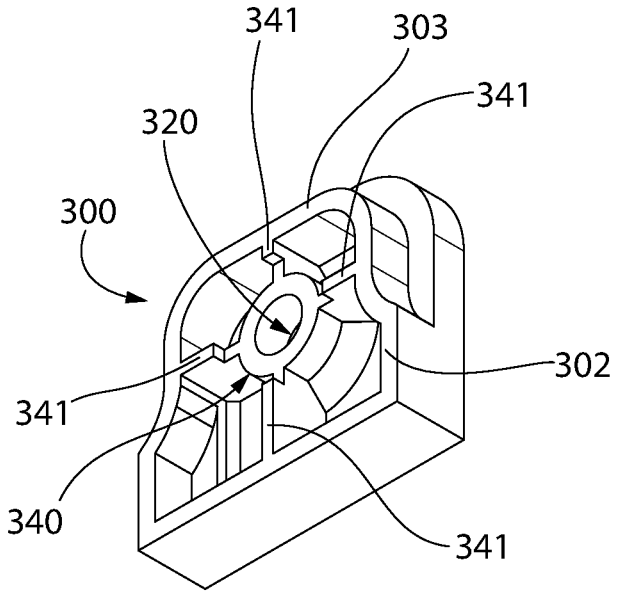

Referring now to FIGS. 7A-7C and to FIGS. 8A-8C, the first and second mounting brackets 200, 300 will be described. FIGS. 7A-7C illustrates one of the first mounting brackets 200 and FIGS. 8A-8C illustrates one of the second mounting brackets 300. The first and second mounting brackets are identical in all respects except for the shape of the mounting aperture formed therein. Thus, most of the discussion and description of the first and second mounting brackets 200, 300 will be made with reference to the first mounting bracket 200, it being understood that all of the description of the first mounting bracket 200 is also applicable to the second mounting bracket 300 except for the discussion of the mounting aperture. Thus, a separate discussion of the mounting aperture of the second mounting bracket 300 will be provided herein for ease of understanding of the differences between the first and second mounting brackets 200, 300. To be clear, the features that are common to both of the first and second mounting brackets 200, 300 will be described in detail with reference to the first mounting bracket 200 and that description is entirely applicable to the second mounting bracket 300.

The first mounting bracket 200 comprises a front surface 201, a rear surface 202, and a peripheral edge 203 that extends between the front and rear surfaces 201, 202. Furthermore, the first mounting bracket 200 comprises an anterior portion 204 and a posterior portion 205. The anterior and posterior portions 204, 205 are located on opposite sides of a plane that is parallel to the front and rear surfaces 201, 202 and which that intersects the first mounting bracket 200 at a location that is equidistant to the front and rear surfaces 201, 202. The anterior portion 203 of the first mounting bracket 200 comprises the front surface 201 and a front portion 206 of the peripheral edge 203. The posterior portion 204 of the first mounting bracket 200 comprises the rear surface 202 and a rear portion 207 of the peripheral edge 203.

A lower portion of the rear portion of the peripheral edge 203 is flush with a lower portion of the front portion 206 of the peripheral edge 203. An upper portion 208 of the rear portion 207 of the peripheral edge 203 is recessed relative to an upper portion 209 of the front portion 206 of the peripheral edge 203. Stated another way, the anterior portion 204 of the first mounting bracket 200 comprises an extended portion 210 that extends beyond the rear portion 207 of the peripheral edge 203 along the upper portion 208 thereof. Because the extended portion 210 extends beyond the posterior portion 205, the extended portion 210 has a rear surface 211 that is exposed and visible when the first mounting bracket 200 is viewed from the rear surface 201 as in FIG. 7C. As will be discussed in more detail below, the extended portion 210 of the anterior portion 204 of the first mounting bracket 200 is configured to nest within the undercut portion 123 of the first mounting channel 110 of the wall décor item 100 when the wall décor item 100 is mounted to the first mounting bracket 200. Furthermore, when the first mounting bracket 200 is mounted to the wall, a gap or space exists between the rear surface 211 of the extended portion 210 and the wall, and the overhang portion 224 of the wall décor item 100 nests within that gap or space to facilitate the mounting of the wall décor item 100 to the first mounting bracket 200.

The upper portion 208 of the rear portion 207 of the peripheral edge 203 formed by the posterior portion 205 of the mounting bracket 200 comprises a first arcuate portion 212 and a second arcuate portion 213. In the exemplified embodiment, the first and second arcuate portions 212, 213 are concave. The first and second arcuate portions 212, 213 are configured to mate with the arcuate portions 121 of the wall 112 when the first mounting bracket 200 is nesting within the first mounting channel 110 of the wall décor item 100. Thus, while the first and second arcuate portions 212, 213 are concave and the arcuate portions 121 of the wall 112 are convex, this could be switched in other embodiments. In still other embodiments, the first and second arcuate portions 212, 213 and the arcuate portions 121 of the wall 112 could be planar horizontal walls instead of being arcuate while still permitting them to mate as described herein. In still other embodiments, the arcuate nature of the various walls may be removed entirely and the wall 112 of the first mounting channel 110 and the peripheral edge 203 of the first mounting bracket 200 may comprise straight lines only and no arcuate lines in some embodiments. Thus, the specific shape of the first and second mounting elements 200, 300 as shown in the drawings and described herein is not to be limiting of the present invention in all embodiments unless specifically claimed as such.

The first mounting bracket 200 further comprises a first mounting aperture 220 which extends from the front surface 201 of the first mounting bracket 200 to the rear surface 202 of the first mounting bracket 200. Thus, the first mounting aperture 220 extends through the full thickness of the first mounting bracket 200 so that the first fastener 250, or at least the first screw 251 thereof, can be inserted into the first mounting aperture 220 for purposes of mounting the first mounting bracket 200 to the wall.

The first mounting aperture 220 of the first mounting bracket 200 is elongated. In particular, the first mounting bracket 200 comprises a bottom edge 215, a top edge 216, a first lateral side edge 217, and a second lateral side edge 218 (of course, the exact number and arrangement of the edges could be modified with a modification to the overall shape of the first mounting bracket 200 which is possible within the scope of the invention claimed herein). When the first mounting bracket 200 is mounted to a wall, the bottom edge 215 and the top edge 216 are oriented generally horizontally and the first and second lateral side edges 217, 218 are oriented generally vertically. The first mounting aperture 220 is elongated in a direction between the first and second lateral sides 217, 218. Specifically, the first mounting aperture 220 is elongated along an aperture axis B-B that intersects the first and second lateral side edges 217, 218 of the first mounting bracket 200. Stated another way, when the first mounting bracket 200 is mounted to a wall, the first mounting aperture 220 is elongated in a horizontal direction (i.e., a direction parallel to the floor and ceiling of the room in which the wall décor item 100 is hung).

Along the front surface 201 of the first mounting bracket 220, there is an angled wall 230 that surrounds the first mounting aperture 220. The angled wall 230 circumferentially surrounds the first mounting aperture 220. The angled wall 230 is angled downwardly from the front surface 201 of the first mounting bracket 220 in a direction towards the rear surface 202 of the first mounting bracket 220. The angled wall 230 provides a nesting region between the first mounting aperture 220 and the front surface 201 of the first mounting bracket 220 within which a head of the first screw 251 can nest so that a top end of the first screw 251 is either flush with or recessed relative to the front surface 201 of the first mounting bracket 220 when used to couple the first mounting bracket 220 to a wall.

The elongated nature of the first mounting aperture 220 is a key feature of the invention described herein in that it creates a tolerance such that the first mounting bracket 200 can be moved side-to-side along the wall while it is mounted to the wall by the first fastener 250. In particular, with traditional keyways that are affixed to the back of a wall décor item, it is imperative that the screws that are coupled to the wall are at the exact location necessary so that the two screws are each aligned with one of the keyways on the back of the wall décor item. This has proven difficult for the everyday consumer/homeowner, and it can be a source of great frustration when the two screws do not both line up with one of the keyways. In such situations, the consumer/homeowner may attempt to force the keyways to fit onto the screws, which can result in a less than optimal mounting of the wall décor item to the wall or can result in the screw ripping a larger hole in the wall to the point that the screw is no longer tightly held by the wall. In the present invention, this frustration is eliminated because the first mounting bracket 200 is able to slide side-to-side along the wall without having to remove the screw from the first mounting bracket 220 due to the elongated shape of the first mounting aperture 220. Thus, even if the screw is not placed at an optimal position in the wall, the first mounting bracket 200 can slide relative to the screw while mounted on the wall to allow the first and second mounting brackets 200, 300 to simultaneously align with the first and second mounting channels 110, 130 in the rear surface 105 of the wall décor item 105.

A user may have to loosen the first screw 251 slightly to enable the noted side-to-side movement of the first mounting bracket 200 to take place. Specifically, when the first screw 251 is fully screwed to the wall, the first mounting bracket 200 is compressed between the head of the first screw 251 and the wall. Depending on the degree of the compressive force, the first mounting bracket 200 may not be able to move side-to-side along the wall. Thus, a user may need to loosen the screw 251 slightly while keeping the distal portion of the screw 251 embedded in the wall to loosen the compressive force applied onto the first mounting bracket 200 and enable the first mounting bracket 200 to move side-to-side. The user can then re-tighten the first screw 251 when the first mounting bracket 200 is properly positioned relative to the first screw 251.

Figure 13:
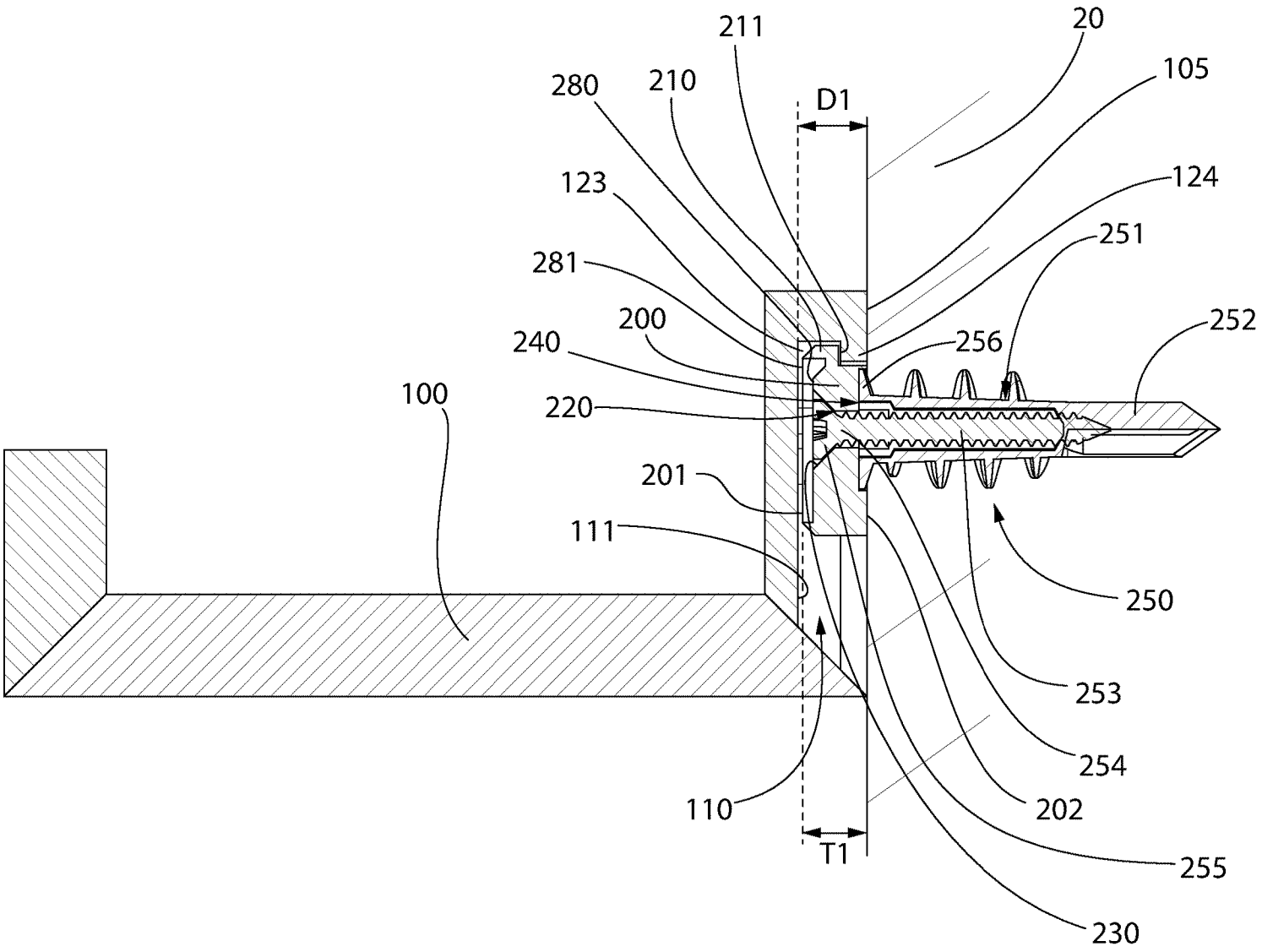
FIG. 13 is a cross-sectional view taken along line XIII-XIII illustrating the engagement between the mounting brackets and the wall décor item that facilitates the hanging of the wall décor item from the wall.

In particular, the first mounting aperture 220 has a width W1 measured in the direction of the aperture axis B-B. In some embodiments, the width W1 may be in a range of 5 mm and 15 mm, and more specifically 7 mm and 10 mm. Referring briefly to FIG. 13, when the first mounting bracket 200 is mounted to a wall by the first screw 251, a first portion 253 of the first screw 251 is embedded within the wall 20, a second portion 254 of the first screw 251 is disposed within the first mounting aperture 220 of the first mounting bracket 200, and a head 255 of the first screw 251 nests within the nesting region of the first mounting aperture 220 defined by the angled wall 230. The second portion 254 of the first screw 251 that is located within the mounting aperture 220 has a diameter which is less than the width W1 of the first mounting aperture 220 (the second portion 254 of the first screw 251 is illustrated in ghost lines in FIG. 7B). As a result, even while the first screw 251 is being used to attach the first mounting bracket 200 to the wall 20, the first mounting bracket 200 can slide side-to-side, with the specific location of the second portion 254 of the first screw 251 within the first mounting aperture 220 changing as the first mounting bracket 200 slides side-to-side. The distance that the first mounting bracket 200 can slide may be equal to the width W1 of the first mounting aperture 220 minus the diameter of the second portion 254 of the first screw 251, and thus this distance may be modified by the manufacturer determining an appropriate width W1 for the first mounting aperture 220 and/or based on the size screw used by the consumer when hanging the wall décor item 100 (the screw may be provided by the manufacturer in some embodiments).

Referring to FIG. 7C, the rear surface 202 of the first mounting bracket 200 comprises a nesting recess 240, which is a portion of the rear surface 202 that is recessed relative to a peripheral portion of the rear surface 202. The nesting recess 240 is a portion of the rear surface 202 which comprises the first mounting aperture 220. The purpose of the nesting recess 240 is to permit a flange of a wall anchor to fit and nest therein when the first mounting bracket 200 is mounted to the wall. That is, some wall anchors include a flange part which lies against the outer surface of the wall when the wall anchor is mounted to the wall. This flange part is able to nest within the nesting recess 240 of the first mounting bracket 200, which allows for the peripheral portion 241 of the rear surface 202 of the first mounting bracket 200 to abut against the outer surface of the wall even if the flange part of the wall anchor is sticking out from the outer surface of the wall. This is because the flange part of the wall anchor can nest within the nesting recess 240 of the first mounting bracket 200.

Referring now to FIGS. 8A-8C, the second mounting bracket 300 will be described. As mentioned above, the second mounting bracket 300 is identical to the first mounting bracket 200 in all aspects except that the second mounting bracket 300 comprises a second mounting aperture 320 which differs from the first mounting aperture 220 of the first mounting bracket 300. Thus, the second mounting bracket 300 comprises a front surface 301 and a rear surface 302 that is opposite the front surface. The rear surface 302 comprises a peripheral portion 303.

In particular, the second mounting aperture 320 is a round or circular hole and it is not elongated in any direction. Thus, when the second mounting bracket 300 is mounted to the wall using the second screw 351, the second mounting bracket 300 is fixed in place and is unable to slide side-to-side along the wall. In particular, the portion of the second screw 351 that is located within the second mounting aperture 320 has a width that is about the same as the diameter of the second mounting aperture 320. Thus, the second mounting bracket 300 is unable to slide side-to-side or in any other direction when it is mounted to the wall with the second screw 351. The remaining features of the second mounting bracket 300 are the same as the first mounting bracket 200 and thus those features are not labeled in the drawings or described herein, it being understood that the description of those features with reference to the first mounting bracket 200 is applicable.

The second mounting bracket 300 comprises a nesting recess 340 on its rear surface much like the nesting recess 240 of the first mounting bracket 200. As seen in FIG. 8C, the nesting recess 340 is defined as the space between the four ribs 341 which extend inwardly from a peripheral portion 303 of the rear surface 302. That is, each of the four ribs 341 extends inwardly from the peripheral portion 303 of the rear surface 302 in a direction towards the second mounting aperture 320. The ribs 341 terminate at a distance from the second mounting aperture 320, creating the nesting recess 340 within the space between the ends of the ribs 341. A flange part of a wall anchor can readily nest within the nesting recess 340 to allow the peripheral portion 303 of the rear surface 302 to abut against the wall when the second mounting bracket 300 is mounted to the wall.

Referring briefly to FIGS. 3 and 4, in the exemplified embodiment the wall hanging system 10 includes one of the first mounting brackets 200 and one of the second mounting brackets 300. The first mounting bracket 200 engages the first mounting channel 110 of the wall décor item 100 and the second mounting bracket 300 engages the second mounting channel 130 of the wall décor item 100 to mount the wall décor item 100 to the wall (the first and second mounting brackets 200, 300 are mounted to the wall before being brought into engagement with the wall décor item 100). In accordance with the exemplified embodiment, if after mounting the first and second mounting brackets 200, 300 to the wall it is found that they do not both simultaneously align with the first and second mounting channels 110, 130 of the wall décor item 100, the user can slide the first mounting bracket 200 along the wall until the first and second mounting brackets 200, 300 are in simultaneous alignment with the first and second mounting channels 110, 130 of the wall décor item 100. In the embodiment of FIGS. 3 and 4, the second mounting bracket 300 cannot slide side-to-side along the wall so it cannot help with achieving this alignment.

However, in other embodiments, the wall hanging system 10 may comprise two of the first mounting brackets 200 instead of one of the first mounting brackets 200 and one of the second mounting brackets 300. In such an embodiment, both of the mounting brackets 200 will be capable of sliding side-to-side along the wall to assist in properly aligning the mounting brackets 200 with the first and second mounting channels 110, 130 in the rear surface 105 of the wall décor item 100. This provides even more tolerance in case the first and second mounting brackets 200 are initially mounted to the wall in locations that do not properly simultaneously align with both of the first and second mounting channels 110, 130 of the wall décor item 100.

Referring to FIGS. 9-12, the process or method of hanging the wall décor item 100 from the wall 20 will be described. In FIGS. 9-12, the wall décor item 100 is being hung with one of the first mounting brackets 200 and one of the second mounting brackets 300. However, as mentioned above, in other embodiments the wall décor item 100 may be hung with two of the first mounting elements 200 to provide additional flexibility/tolerance in the hanging process.

Figure 9:
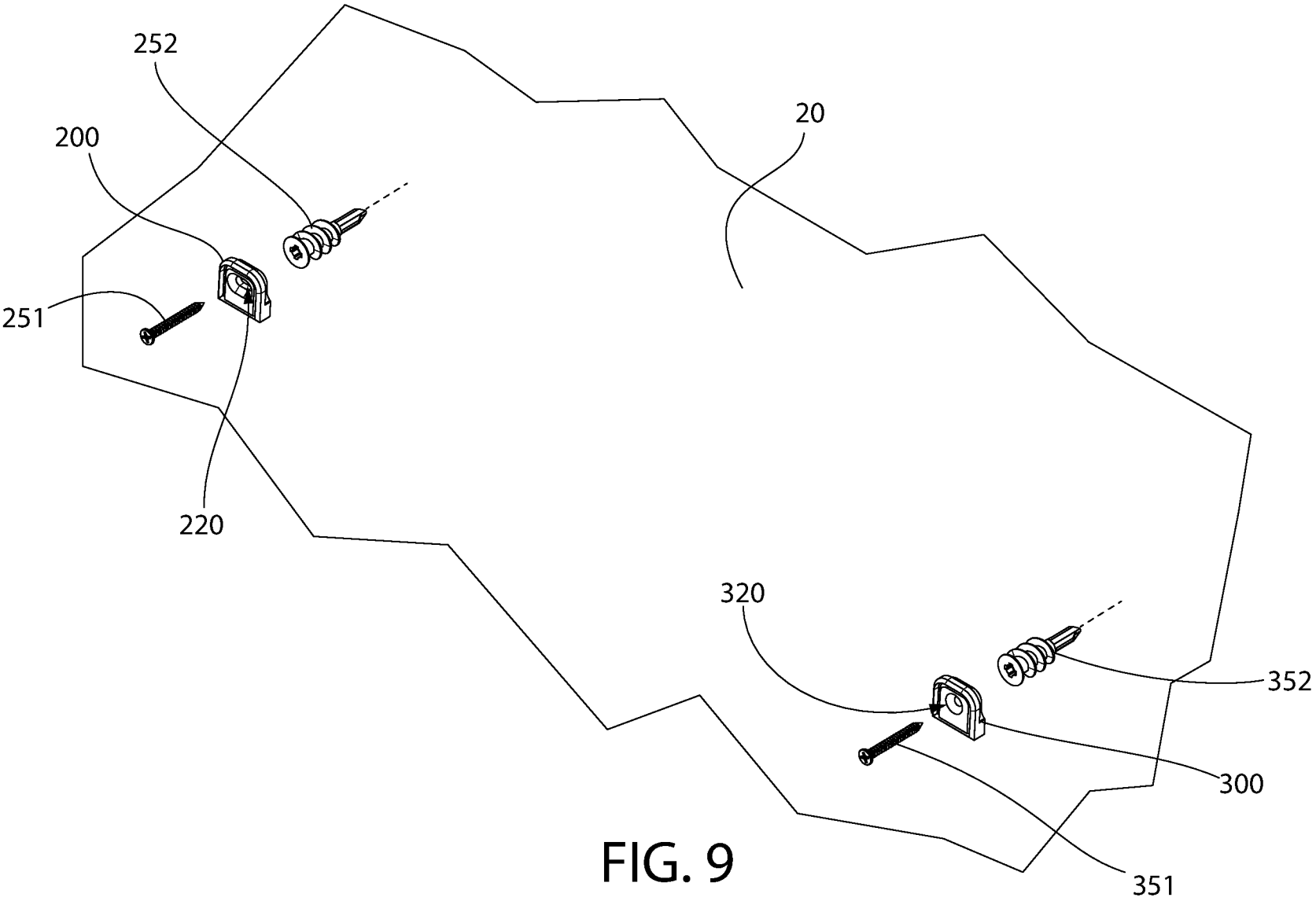
FIG. 9 is a perspective view illustrating the process of mounting one of the mounting brackets of FIGS. 7A-7C and one of the mounting brackets of FIGS. 8A-8C to a wall.

Referring first to FIG. 9, the first step in the process is to insert the first and second anchors 252, 352 into the wall 20. This can be done in several different conventional manners. Some types of wall anchors are designed to be hand-screwed into the wall 20 with the anchors forming a hole in the wall as they are inserted therein. Other wall anchors are intended to be inserted into a pre-drilled hole in the wall 20, and in such instances a user should first drill a hole in the wall 20 and then insert the first and second anchors 252, 352 into the wall 20. Either of these options is acceptable depending on the type of wall anchors being used (which may be provided by the manufacturer in some embodiments). Moreover, as noted above it may be possible to omit using the wall anchors in some embodiments if, for example, you are certain that the fasteners are being screwed into wall studs rather than just drywall or plasterboard.

Prior to pre-drilling the holes or screwing the first and second wall anchors 252, 352 directly into the wall 20, a user may desire to measure the distance between the first and second mounting channels 110, 130 on the rear surface 105 of the wall décor item 100 to ensure that the first and second mounting brackets 200, 300 are being mounted to the wall 20 at the required spacing distance relative to one another. With keyway type mounting devices, the products often arrive with a template that can be held on the wall and which includes circles indicating to the user where he/she should drill the hole in the wall. However, even with such templates users/homeowners have been found to have great difficulty in properly placing the screws on the wall. In the invention described herein, while it is advisable to measure before inserting the wall anchors 252, 352 into the wall, there is some tolerance allotted due to the configuration of the first mounting bracket 200 having the elongated mounting aperture 220 as described herein. Thus, in most if not all instances, the invention described herein eliminates the need for templates. Of course, a template could still be provided to the consumer in order to provide them with more confidence that they are hanging the first and second mounting brackets 200, 300 at the correct spacing distance.

Once the first and second wall anchors 252, 352 have been inserted into the wall, the first and second mounting brackets 200, 300 are aligned with the first and second wall anchors 252, 352. Specifically, the first mounting bracket 200 is positioned adjacent to the wall 20 so that the first mounting aperture 220 is aligned with the hole in the top end of the first wall anchor 252. Similarly, the second mounting bracket 300 is positioned adjacent to the wall 20 so that the second mounting aperture 320 is aligned with the hole in the top end of the second wall anchor 352. Next, the first screw 251 is inserted through the first mounting aperture 220 of the first mounting bracket 200 and into the passageway of the first wall anchor 252 (or directly into a hole in the wall if the first wall anchor 252 is omitted). Similarly, the second screw 351 is inserted through the second mounting aperture 320 of the second mounting bracket 300 and into the passageway of the second wall anchor 352 (or directly into a hole in the wall if the second wall anchor 352 is omitted). The first and second screws 251, 351 are tightened until the heads of the screws 251, 351 apply a compression force onto the first and second mounting brackets 200, 300 thereby holding them tightly in place.

Figure 10:
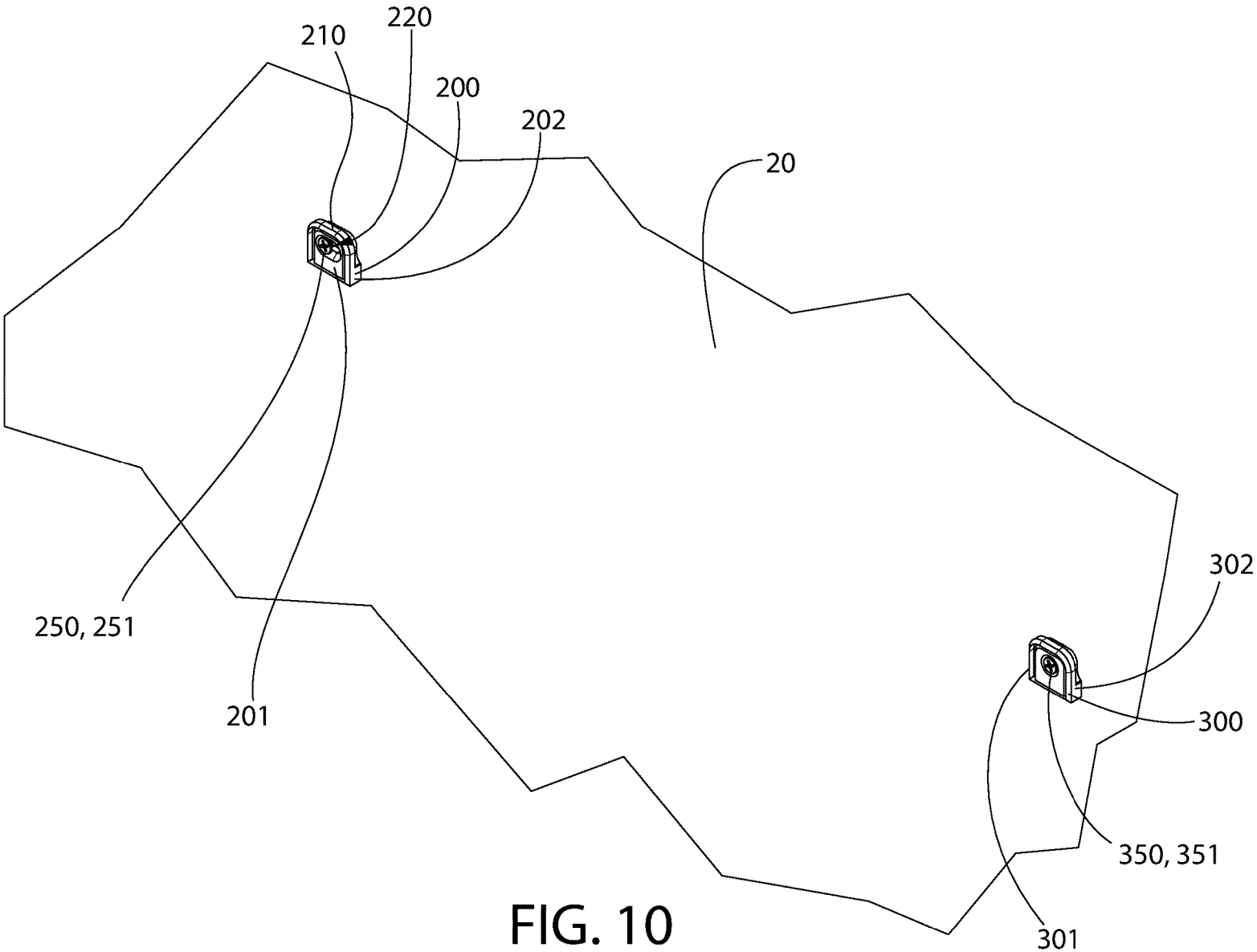
FIG. 10 is a perspective view illustrating the two mounting brackets from FIG. 9 mounted to the wall.

FIG. 10 illustrates the first and second mounting brackets 200, 300 mounted to the wall 20 by the first and second fasteners 250, 350 (specifically, the first and second screws 251, 351 of the first and second fasteners 250, 350). Viewing FIGS. 10 and 13 simultaneously, the rear surface 211 of the extended portion 210 of the first mounting bracket 200 (only labeled with reference to the first mounting bracket 200, but the same relationship exists with the second mounting bracket 300) is spaced from the wall 20 by a gap, which is configured to receive the overhang portion 124 of the wall décor item 100 to facilitate the mounting of the wall décor item 100 to the first and second mounting brackets 200, 300. Moreover, the first and second mounting brackets 200, 300 are mounted to the wall 20 with the front surfaces 201, 301 thereof facing away from the wall 20 and the rear surfaces 202, 302 thereof facing or in abutment with the wall 20.

Figure 11:
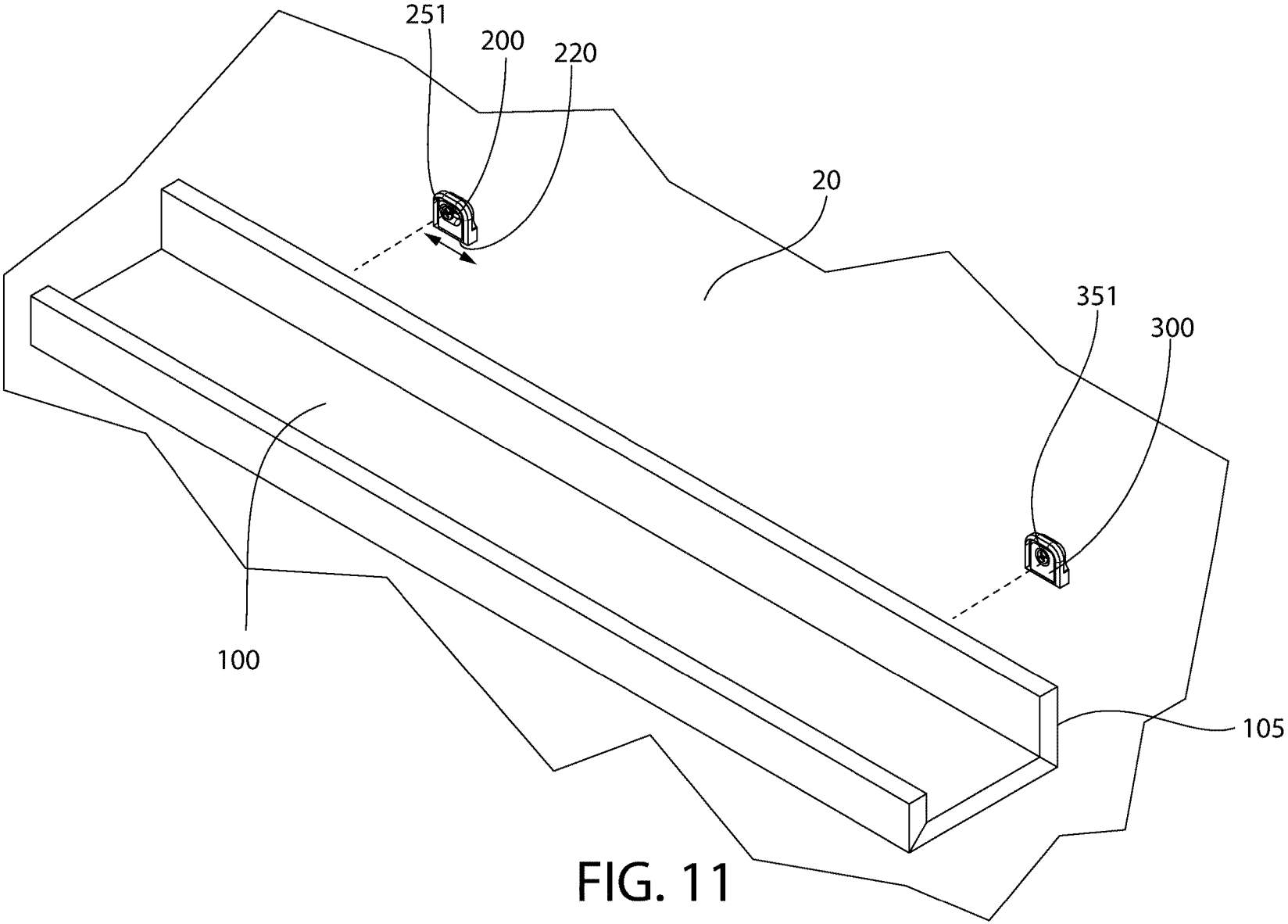
FIG. 11 is a perspective view illustrating a wall décor item being brought into alignment with the two mounting brackets that are mounted to the wall from FIG. 10.

Referring to FIG. 11, the next step is to hold the wall décor item 100 up to the wall 20 with the rear surface 105 of the wall décor item 100 facing the wall 20. At this step, the user should try to determine if the first and second mounting channels 110, 130 in the rear surface 105 of the wall décor item 100 can be simultaneously aligned with the first and second mounting brackets 200, 300 that are mounted to the wall 20. This can be done by attempting to simultaneously insert the first and second mounting brackets 200, 300 into the first and second mounting channels 110, 130. If there is any difficultly in doing this, it is likely that the first and second mounting brackets 200, 300 are not spaced apart by an appropriate distance to enable them to both simultaneously slide into the first and second mounting channels 110, 130 on the rear surface 105 of the wall décor item 100. In this situation, the user should work to determine whether the first and second mounting brackets 200, 300 are too close together or too far apart.

Once the user has determined which direction the first and/or second mounting brackets 200, 300 need to move, the user can very minimally loosen the first screw 251 so that it is not applying too great of a compressive force onto the first mounting bracket 200 that the first mounting bracket 200 cannot be moved side-to-side along the wall 20 (in some instances this may not be necessary if the user can slide the first mounting bracket 200 along the wall 20 without loosening the first screw 251). Once the first screw 251 has been loosened, the first mounting bracket 200 should be moved either towards the second mounting bracket 300 or away from the second mounting bracket 300, depending on whether the first and second mounting brackets 200, 300 were initially too far apart or too close together. Once the first mounting bracket 200 has been moved the desired amount, the user can tighten the first screw 251 to compress the first mounting bracket 200 between the first screw 251 and the wall 20 to prevent accidental side-to-side movement. It should be noted that in some instances it may be possible to slide the first mounting bracket side-to-side along the wall 20 without having to loosen the first screw 251.

As discussed above, in this embodiment the first mounting bracket 200 is configured to move side-to-side while mounted to the wall 20 due to it having the elongated mounting aperture 220. Furthermore, in this embodiment the second mounting bracket 300 is not able to slide side-to-side along the wall while mounted to the wall because its mounting aperture 330 is round/circular and not elongated. However, the second mounting bracket 300 could also include an elongated mounting aperture so that both of the first and second mounting brackets 200, 300 are about to slide side-to-side along the wall 20 while mounted to the wall 20.

In some embodiments the first mounting bracket 200 may be able to move along the wall a distance of between 1 mm and 10 mm, or more specifically between 3 mm and 7 mm. In one particular embodiment, the width W1 of the first mounting aperture 220 may be about 9 mm and the diameter of the screw 251 may be about 4 mm, thereby providing about 5 mm of sliding movement of the first mounting bracket 200 relative to the first screw 251 which is fixed to the wall 20.

Once the first and second mounting brackets 200, 300 are properly spaced apart from one another, the wall décor item 100 can be mounted to the first and second mounting brackets 200, 300, which in turn results in the wall décor item 100 being mounted to the wall 20.

Figure 12:
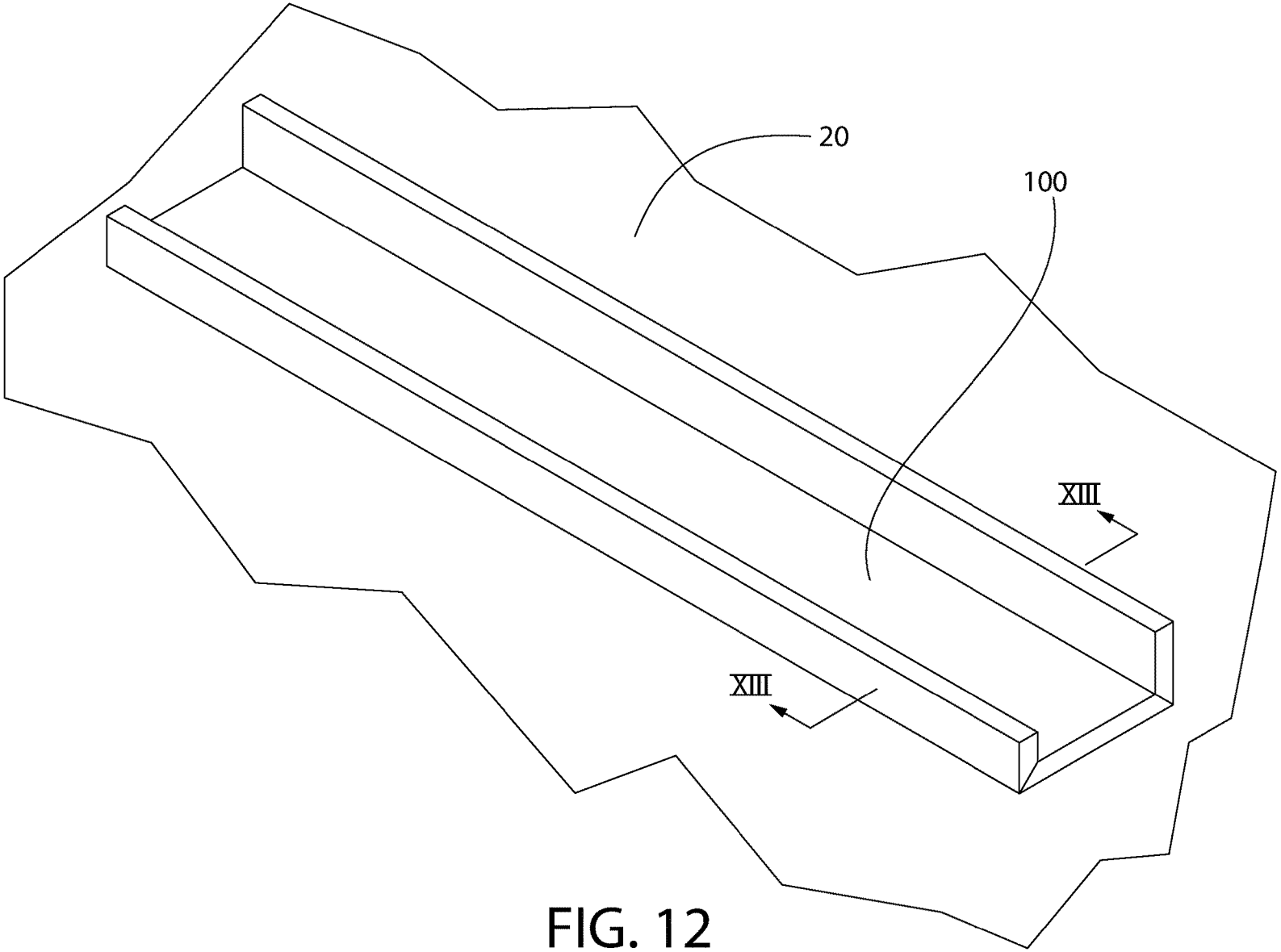
FIG. 12 is a perspective view illustrating the wall décor item mounted to the wall.

FIGS. 12 and 13 illustrate the wall décor item 100 mounted to the wall 20 via the first and second mounting brackets 200, 300. When attaching the wall décor item 100 to the first and second mounting brackets 200, 300, the wall décor item 100 is positioned with the rear surface 105 of the wall décor item 100 facing or in abutting contact with the wall 20. When moving the wall décor item 100 towards the wall 20, the first and second mounting channels 110, 130 should be aligned with the first and second mounting brackets 200, 300, respectively. Thus, as the rear surface 105 of the wall décor item 100 comes into contact with the wall 20, the first and second mounting brackets 200, 300 are received inside of the first and second mounting channels 110, 130. Next, the wall décor item 100 can be slid downwardly (i.e., towards the floor and away from the ceiling of the room in which the wall décor item 100 is being hung) until the extended portion 210 of the first and second bracket members 200, 300 nests within the undercut portion 123 of the first and second mounting channels 110, 130.

The relationship between the mounting brackets and the mounting channels will now be described further with reference to the first mounting bracket 200 and the first mounting channel 110, it being understood that the same description applies to the second mounting bracket 300 and the second mounting channel 130. When the extended portion 210 of the first bracket member 200 nests within the undercut portion 123 of the first mounting channel 110, the extended portion 210 of the first bracket member 200 is positioned between the floor 111 of the first mounting channel 110 and the overhang portion 124 of the wall décor item 100. Furthermore, the overhang portion 124 is located between the rear surface 211 of the extended portion 210 of the first bracket member 200 and the wall 20. Thus, the wall décor item 100 cannot be removed from the wall 20 simply by pulling on the wall décor item 100 in a direction that is normal to the wall 20. Rather, the wall décor item 100 must first be slid upwardly to remove the overhang portion 124 from the space between the extended portion 210 of the first bracket member 200 and the wall 20, which simultaneously removes the extended portion 210 of the first bracket member 200 from the undercut portion 123 of the first mounting channel 110. Once this is achieved, the wall décor item 100 can be moved away from the wall 20.

As seen in FIG. 13, the first mounting channel 110 comprises a first depth D1 measured from the floor 111 of the first mounting channel 110 to the rear surface 105 of the wall décor item 100. The first mounting bracket 200 comprises a first thickness T1 measured from the front surface 201 of the first mounting bracket 200 to the rear surface 202 of the first mounting bracket 200. The first depth D1 of the first mounting channel 110 is equal to or greater than the first thickness T1 of the first mounting bracket 200 so that the rear surface 202 of the first mounting bracket 200 is flush with or recessed relative to the rear surface 105 of the wall décor item 100 when the first mounting bracket 200 nests within the first mounting channel 110. A similar relationship exists between the second mounting channel 130 and the second mounting bracket 300. In the exemplified embodiment, when the wall décor item 100 is mounted to the wall 20 via the first and second mounting brackets 200, 300, the rear surface 105 of the wall décor item 100 is in surface contact with the wall 20. In other embodiments, there may be a slight gap between the rear surface 105 of the wall décor item 100 and the wall 20.

As noted previously, the first and second mounting brackets 200, 300 each have a nesting recess 240, 340 on their respective rear surfaces 202, 302 for receiving part of the anchor 252. In particular, as shown in FIG. 13, a flange part 256 of the anchor 252 rests against the outer surface of the wall 20, such that the flange part 256 protrudes from the outer surface of the wall 20. That is, the flange part 256 is not flush with or recessed relative to the wall 20, but rather sticks out past the outer surface of the wall 20. Thus, in order to allow for the first mounting bracket 200 to abut against the wall, the flange part 256 of the anchor 252 nests within the nesting recess 240 in the rear surface 202 of the first mounting bracket 200.

Moreover, it is noted that the front surface 201 of the first mounting bracket 200 includes an interior portion 280 and a peripheral portion 281. The interior portion 280 is recessed relative to the peripheral portion 281. The mounting aperture 220 is located within the interior portion 280, and the peripheral portion 281 surrounds the interior portion 280. The reason for recessing the interior portion 280 relative to the peripheral portion 281 is that is provides a space for the head 255 of the screw 251 to protrude from the mounting aperture 220 without interfering with the ability to mount the wall décor item 100 to the first mounting bracket 200.

Figure 14:
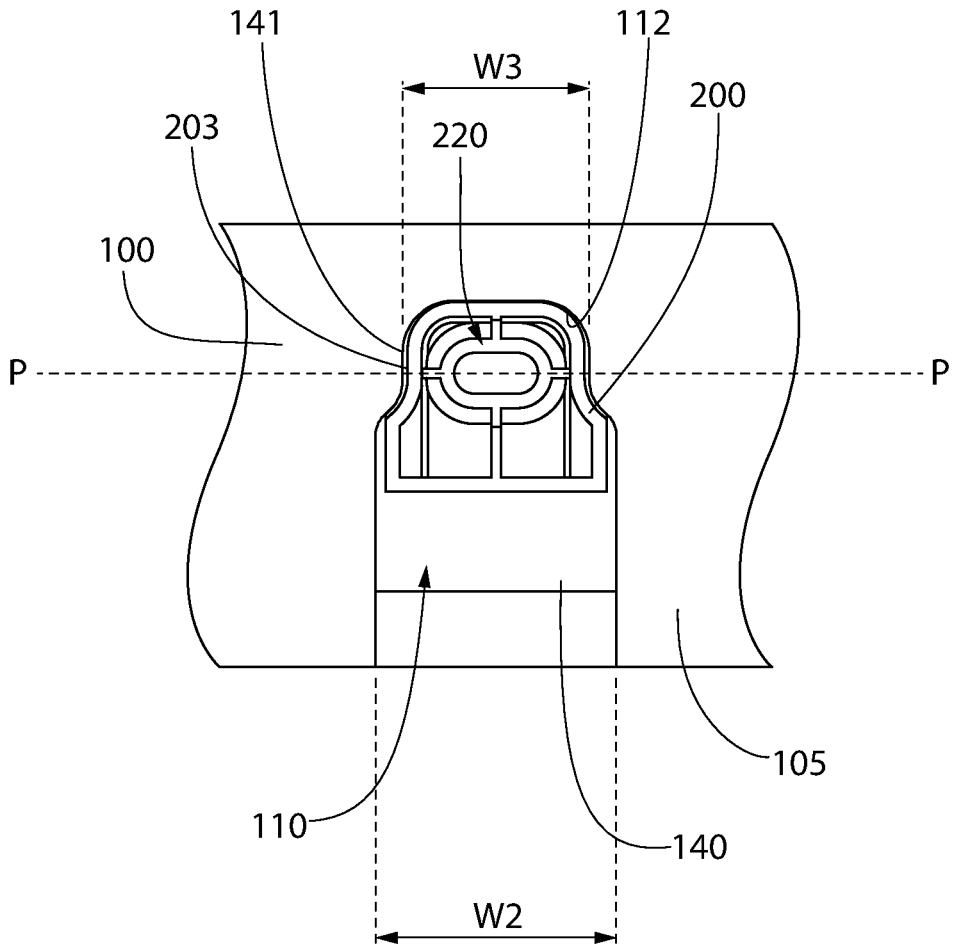
FIG. 14 is a close-up rear view of a portion of the wall décor item with one of the mounting brackets from FIGS. 7A-7C nesting within a mounting channel of the wall décor item.

FIG. 14 is a partial rear view of the wall décor item 100 with the first mounting bracket 200 nesting within the first mounting channel 110. FIG. 14 illustrates the snug/tight fit between the first mounting bracket 200 and the first mounting channel 110. Although not shown, it should be appreciated that an identical tight fit is formed between the second mounting bracket 300 and the second mounting channel 130. In particular, as seen in FIG. 14, the first mounting bracket 200 fits within the first mounting channel 110 with very little tolerance. Specifically, there is very little space, if any, between the peripheral edge 203 of the first mounting bracket 200 and the wall 112 that defines the peripheral boundary of the first mounting channel 110. However, because the first mounting bracket 200 includes the elongated mounting apertures 220 as described herein, this proper alignment between the first mounting bracket 200 and the first mounting channel 110 is easy to achieve.

To describe the tight fit, it is noted that along any location at which a horizontal plane intersects the first mounting channel 110 and the first mounting bracket 200, the first mounting channel 110 has a width that is no more than 1-2 mm, or no more than 1 mm greater than the width of the first mounting bracket 200. An example horizontal plane is shown as plane P-P. It is noted that there may be greater differentials between the widths of the first mounting channel 110 and the first mounting bracket 200 along some planes that intersect both, as long as the differential between the widths at one location (i.e., along one horizontal plane) is within the range noted above. Thus, when the wall décor item 100 is mounted to the first and second mounting brackets 200, 300 which are mounted on the wall 20, the wall décor item 100 can move only a de minimis amount, said de minimis amount being equal to the smallest difference between the width of the first mounting channel 110 and the width of the mounting bracket 200 measured along a horizontal plane that intersects the first mounting channel 110 and the mounting bracket 200. Thus, as used herein the term de minimis includes a movement of 1.5 mm or less.

Referring to FIGS. 5 and 14, it is noted that the shape of the first and second mounting channels 110, 130 helps to ensure that the first and second mounting brackets 200, 300 can fit therein despite the small tolerance in the sizes of the mounting brackets 200, 300 relative to the channels 110, 130. In particular, the first and second mounting channels 110, 130 (described with reference to the first mounting channel 110, but applicable to both) comprise a lower section 140 having a width W2 and an upper section 141 having a width W3, the width W2 of the lower section 140 being greater than the width W3 of the upper section 141. This change in the width is due to the arcuate shape of the wall 112 as described above. Because the lower section 140 has a greater width, the first and second mounting brackets 200, 300 can readily be received within the lower section 140 of the first and second mounting channels 110, 130 and then when the wall décor item 100 is slid downwardly relative to the first and second mounting brackets 200, 300 portions of the first and second mounting brackets 200, 300 enter into and nest within the upper section 141 of the first and second mounting channels 110, 130 to create the tight fit described herein. There is very little, if any, tolerance between the mounting brackets 200, 300 and the sidewalls which define the mounting channels 110. Thus, when the wall décor item 100 is mounted to the mounting brackets 200, 300 (i.e., when the mounting brackets 200, 300 are nested within the mounting channels 110), there is very little, if any, ability to slide the wall décor item 100 side-to-side along the wall. While some tolerance (in the order of 1 mm or less, or 0.5 mm or less) may be desirable to make it easier to attach the wall décor item to the mounting brackets 200, 300, significant tolerance is undesirable because once the wall décor item 100 is mounted to the wall there is little desire for it to be able to move horizontally along the wall. That is, the width-wise dimensions of the mounting channel 110 should closely correspond to the width-wise dimensions of the mounting brackets 200, 300 (the width-wise dimensions of the mounting channel 110 may be up to 0.5 mm, or up to 1 mm greater than the width-wise dimensions of the mounting channels 110 in some embodiments).

Figure 15:
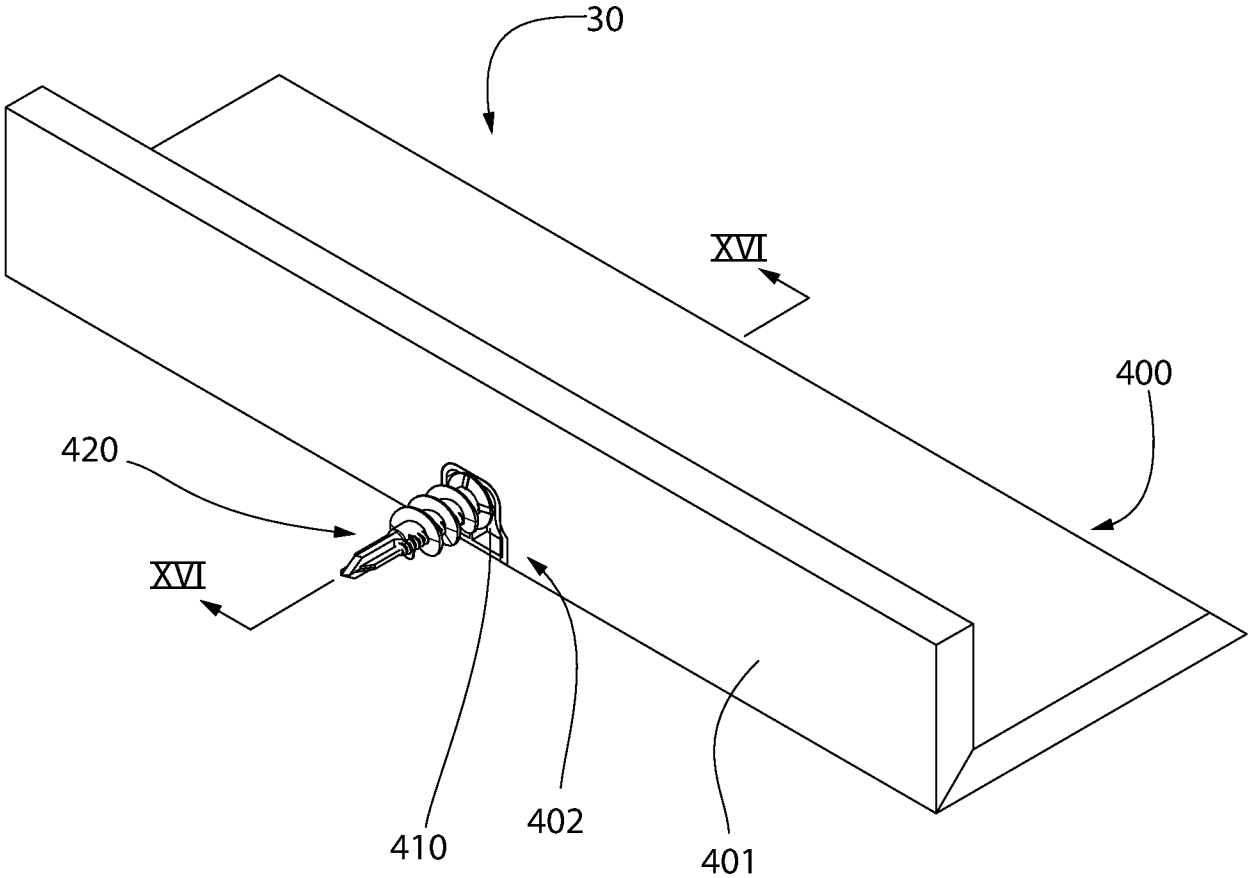
FIG. 15 is a rear perspective view of a wall hanging system in accordance with an alternative embodiment of the present invention.
Figure 16:
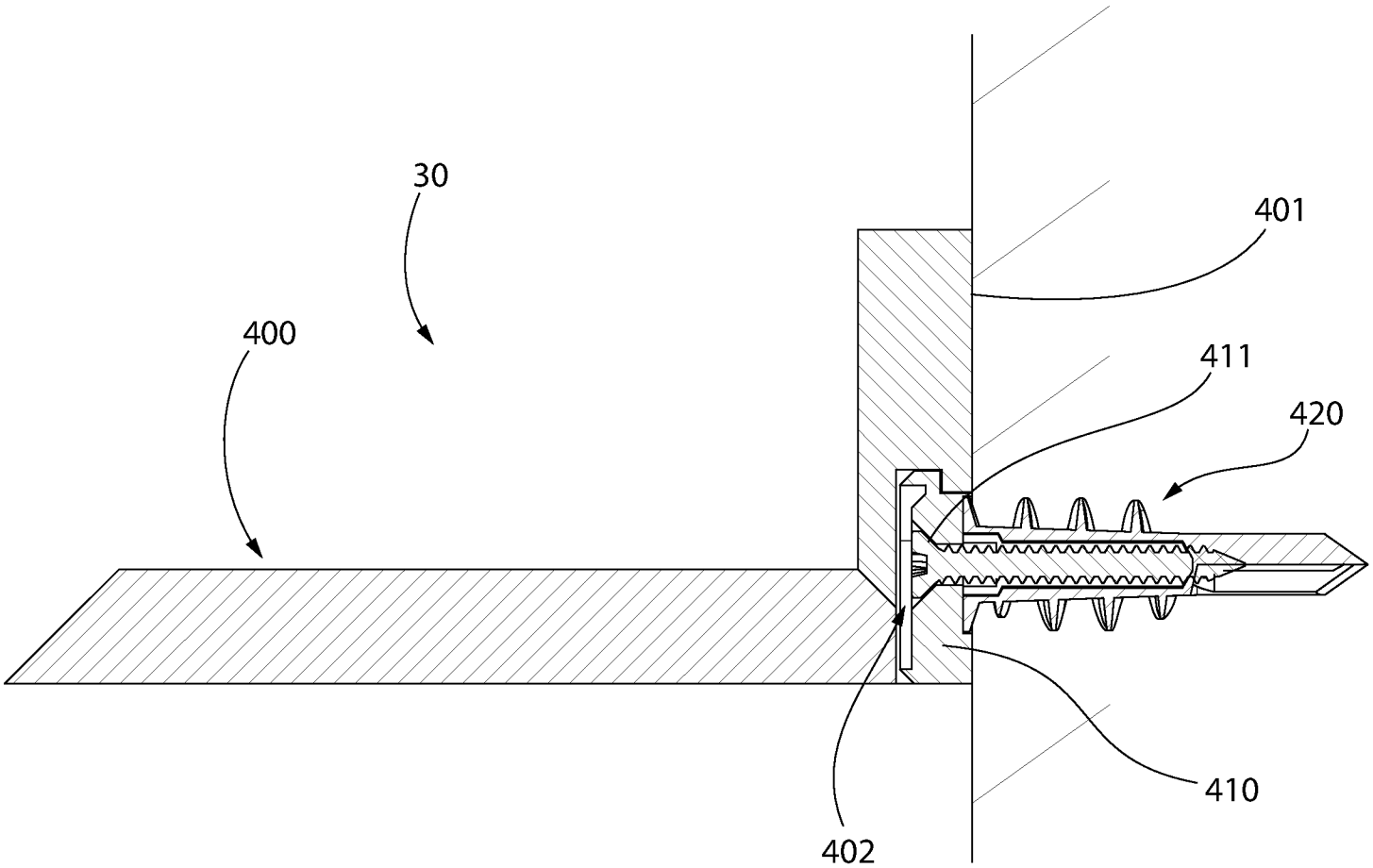
FIG. 16 is a cross-sectional view taken along line XVI-XVI of FIG. 15, with the wall décor item and mounting bracket thereof mounted to a wall.

Referring now to FIGS. 15 and 16, an alternative embodiment of a wall hanging system 30 is illustrated. The wall hanging system 30 is very similar to the wall hanging system 10 described above, except for the differences described below.

The wall hanging system 30 generally comprises a wall décor item 400 having a rear surface 401 with a mounting channel 402 formed therein and a mounting bracket 410 that is configured to be received within the mounting channel 402. The mounting channel 402 is identical to the first and second mounting channels 110, 130 described above and the mounting bracket 410 is identical to the first mounting bracket 200 described above. That is, the mounting bracket 410 includes an elongated mounting aperture 411 for receiving a fastener 420. Thus, in this embodiment the wall hanging system 30 includes only one mounting bracket for mounting the wall décor item 400 to the wall.

An additional difference between the wall hanging system 30 and the wall hanging system 10 is that the mounting channel 402 of the wall décor item 400 extends all the way to the bottom surface of the wall décor item 400. This may make it easier to mount the wall décor item 400 to the mounting bracket 410, but may also be a less desirable aesthetic because the opening in the bottom of the wall décor item 400 may be visible to a user depending on the height at which the wall décor item 400 is mounted along a wall.

Several advantages of the wall hanging system 10 have been described throughout this document as compared to the conventional wall hanging techniques. One advantage not previously mentioned is that the wall hanging system 10 may reduce the labor and cost by eliminating screws in the manufacturing process. In particular, with the prior keyway technique, the keyway bracket had to be pre-mounted to the rear surface of the wall décor item with screws. Thus, screws were needed in the manufacturing operation, which increased the labor, time, and cost to manufacture each product. In the present invention, the mounting brackets 200, 300 are not mounted to the wall décor item 100 during manufacturing. Rather, the wall décor item 100 is manufactured with the mounting channels 110, 130 therein, and the user screws the first and second mounting brackets 200, 300 to the wall during installation. Thus, there are no screws in the manufacturing process of the present invention.

Figure 17:
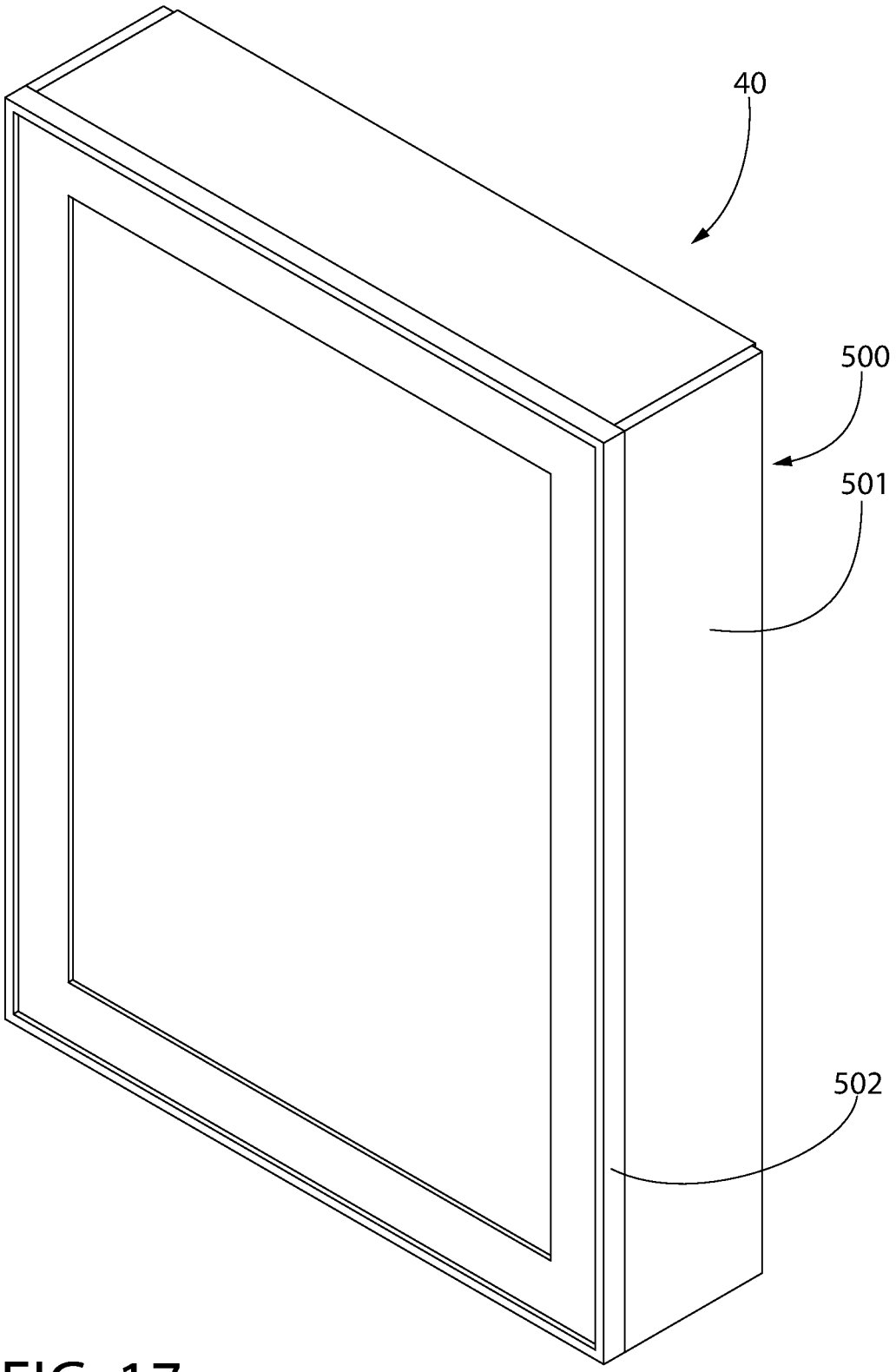
FIG. 17 is a front perspective view of a cabinet of a wall hanging system in accordance with another embodiment of the present invention.

FIGS. 17-20 illustrate a wall hanging system 40 in accordance with another embodiment of the present invention. Referring first to FIG. 17, the wall hanging system 40 comprises a wall décor item 500 which, in this embodiment, is a cabinet. In particular, the wall décor item 500 is a cabinet comprising a main housing 501 and a door 502. The door 502 may pivot or slide or rotate or the like relative to the main housing 501 between a closed state (as shown) and an open state (not shown). When in the open state, an interior 503 (see FIG. 20) of the main housing 501 is exposed so that a user can place items into the interior 503 of the main housing 501 and remove items from the interior 503 of the main housing 501 for use. The wall décor item 500 may be a bathroom cabinet or medicine cabinet or it may be a kitchen cabinet, or any other type of cabinet. Furthermore, while the cabinet is illustrated with the door 502 in the exemplified embodiment, the cabinet need not have a door in all embodiments and could include a main housing 501 which defines an interior cavity without having a door that can close the interior cavity from view.

Figure 18:
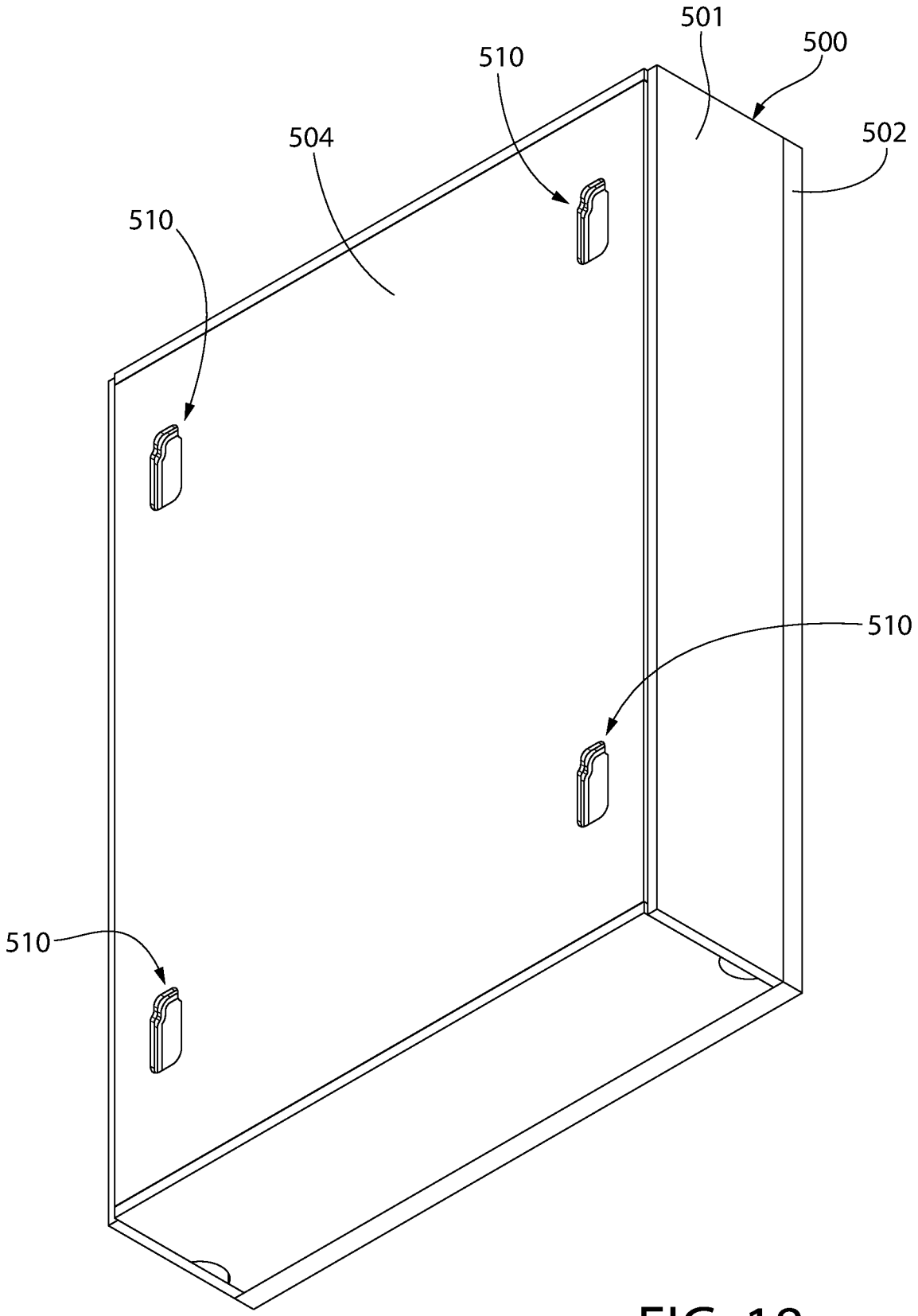
FIG. 18 is a rear perspective view of the cabinet of FIG. 17, illustrating mounting channels formed into a rear surface of the cabinet.

Referring to FIG. 18, the wall décor item 500 comprises a rear surface 504, which is formed by the rear surface of the main housing 501. The rear surface 504 of the wall décor item 500 is configured to face a wall when the wall décor item 500 is mounted to the wall. Furthermore, the wall décor item 500 comprises four mounting channels 510 formed into the rear surface 504 in this embodiment. In this particular embodiment, the rear surface 504 of the wall décor item 500 comprises a longitudinal axis C-C. Two of the mounting channels 510 are located on one side of the longitudinal axis C-C and two of the mounting channels 510 are located on the other side of the longitudinal axis C-C. In some other embodiments, it may be possible to mount the wall décor item 500 using only the two top mounting channels 510, while omitting or simply not using the two bottom mounting channels 510. The mounting channels 510 have a virtually identical shape to the mounting channels 110 previously described, except that the mounting channels 510 are bounded by a fully enclosed boundary wall rather than extending down to a bottom surface of the wall décor item 500 as with the prior described embodiments.

Figure 19:
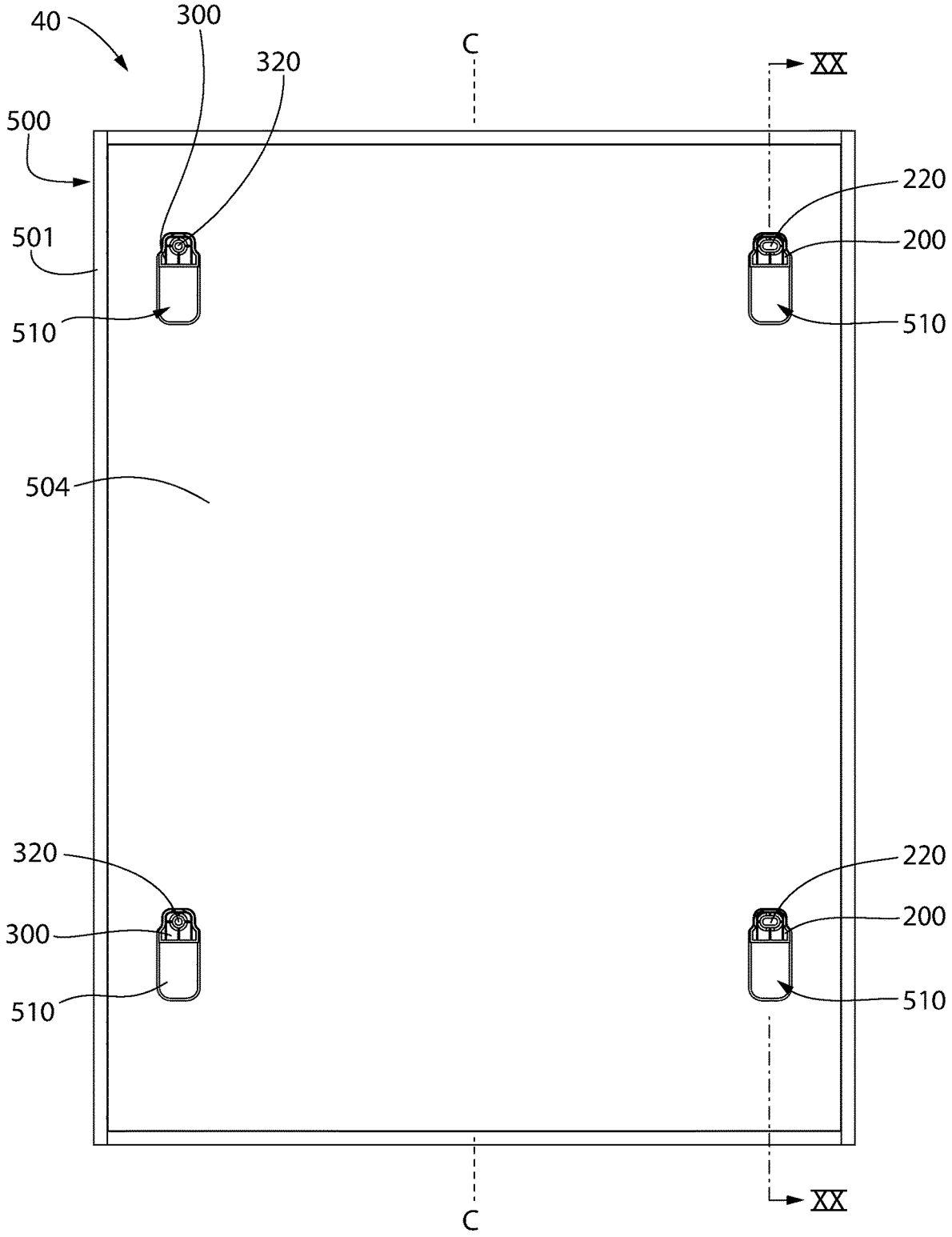
FIG. 19 is a rear view of the cabinet of FIG. 18 with mounting brackets disposed within the mounting channels.

Referring to FIG. 19, the wall hanging system 40 is illustrated with a rear view of the wall décor item 500 and with one of the first mounting brackets 200 disposed within two of the mounting channels 510 and one of the second mounting brackets 300 disposed within the other two of the mounting channels 510. In particular, the first mounting brackets 200 with the oval-shaped or elongated first mounting apertures 220 are disposed within the two mounting channels 510 on the first side of the longitudinal axis C-C and the second mounting brackets 300 with the circular shaped mounting apertures 320 are disposed within the two mounting channels 510 on the second side of the longitudinal axis C-C. Of course, in some embodiments various different ones of the first mounting brackets 200 may be located within each of the mounting channels 510. As noted above, the first mounting brackets 200 are configured to slide side-to-side along the wall even when mounted thereto by a screw due to the fact that the mounting apertures 220 thereof are elongated. Thus, by loosening the screw slightly, the first mounting brackets 200 can be slide horizontally along the wall. This can be desirable to enable a user to adjust the location of the first mounting brackets 200 within a small distance (1 mm-5 mm, for example) in order to ensure proper alignment between the various mounting brackets 200, 300 and the various mounting channels 510 of the wall décor item 500. Thus, the elongated nature of the mounting apertures 220 provides an improvement over prior keyhole style mounting features by allowing for some movement tolerance in the event that placement of the mounting brackets 200, 300 on the wall is not exactly perfect in the first instance.

As should be readily appreciated based on the description above, the wall décor item 500 is mounted to the wall in the following manner. First, a user should measure the distances between the various mounting channels 510, and then couple the mounting brackets 200, 300 to the wall in locations that will ensure that all four of the mounting brackets 200, 300 will align with one of the mounting channels 510 at the same time. Of course, it is possible that a user may measure incorrectly, and in such a situation the user will be able to slide the mounting brackets 200 which include the elongated mounting apertures 220 horizontally along the wall in order to reposition them for alignment with one of the mounting channels 510. Next, the wall décor item 500 is translated towards the wall so that each of the mounting brackets 200, 300 can nest within a lower part of one of the mounting channels 510. Finally, the wall décor item 500 is lowered to allow the mounting brackets 200, 300 to slide into the upper portions of the mounting channels 510, whereby the mounting brackets 200, 300 will support the wall décor item 500 and mount it to the wall.

Figure 20:
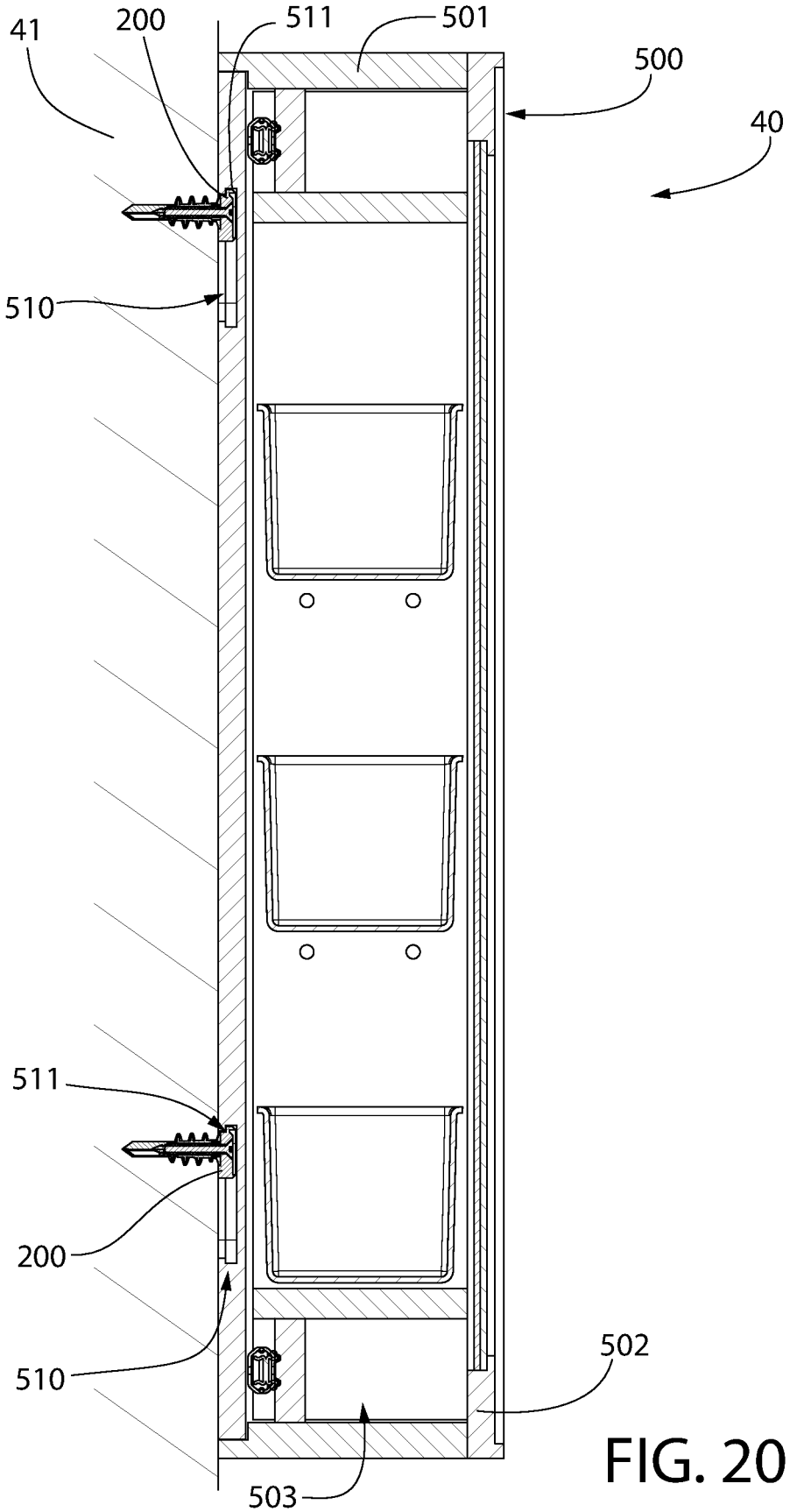
FIG. 20 is a cross-sectional view taken along line XX-XX of FIG. 19, and with the cabinet illustrated mounted on a wall.

Finally, FIG. 20 is a cross-sectional view illustrating the wall décor item 500 mounted to a wall 41 via the mounting brackets 200, 300 (although the cross-section is taken only through the mounting brackets 200 so none of the mounting brackets 300 are shown in FIG. 20). As described above with regard to the prior embodiments and this one, the wall décor item 500 is mounted to the wall 41 by being hung from the mounting brackets 200, 300 which are mounted directly to the wall 41 using hardware such as screws and wall anchors. The elongated apertures 220 of the mounting brackets 200 allows for some tolerance so that the mounting brackets 200 can be slid horizontally along the wall 41 to ensure that all mounting brackets 200, 300 are aligned with one of the mounting channels 510 in the rear surface 504 of the wall décor item 500. Portions of the mounting brackets 200, 300 nest within undercut regions 511 of the mounting channels 510 so that the wall décor item 500 cannot be removed from the wall 41 by simply pulling on the wall décor item 500 in a direction away from the wall 41. Rather, the wall décor item 500 must first be lifted upwardly to remove the portions of the mounting brackets 200, 300 from the undercut regions 511 of the mounting channels 510, and then the wall décor item 500 can be pulled away from the wall 41 to demount the wall décor item 500 from the wall 41.

Thus, it should be appreciated that the wall hanging techniques described herein can be used for a variety of different types of items that are intended to be hung from a wall. The specific embodiments disclosed herein are directed to shelves/ledges and cabinets, but other wall-mountable items may also be used as the wall décor items in other embodiments, examples of which have been provided herein above, but are not intended to be limiting of the invention unless specifically claimed as such. Ledges, cabinets, frames, mirrors, artwork, televisions, accessories, lighting devices, baskets, hook assemblies, or any other type of item may be hung from a wall using the techniques described herein. The wall décor items may be functional in additional to aesthetic, or may be just aesthetic or just functional. In the case of ledges, shelves, and cabinets, these are all functional and also aesthetic. In the face of picture frames, these are aesthetic and not really functional.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A wall hanging system comprising:

a shelf comprising a first side edge, a second side edge, and a rear surface that extends continuously between the first and second side edges, the rear surface being configured to abut against a wall on which the shelf is mountable, a first mounting channel and a second mounting channel formed into the rear surface of the shelf in a spaced apart manner, each of the first and second mounting channels being defined by a floor that is recessed relative to the rear surface and a sidewall that extends from the floor to the rear surface, wherein each of the first and second mounting channels is set inwardly from the first and second side edges of the shelf;

a first mounting bracket comprising a front surface, a rear surface, a first lateral edge, a second lateral edge, and a first mounting aperture extending from the front surface to the rear surface, the first mounting aperture receiving a first fastener for mounting the first mounting bracket to the wall, the first mounting aperture being elongated in a direction between the first and second lateral edges so that the first mounting bracket is configured to slide side-to-side along the wall;

a second mounting bracket comprising a front surface, a rear surface, and a second mounting aperture extending from the front surface to the rear surface, the second mounting aperture being circular and non-elongated and receiving a second fastener for mounting the second mounting bracket to the wall so that the second mounting bracket is configured to be in a fixed position on the wall; and wherein the first mounting bracket nests within the first mounting channel so that at least a portion of a periphery of the first mounting bracket engages at least a portion of the sidewall of the first mounting channel and the second mounting bracket nests within the second mounting channel so that at least a portion of a periphery of the second mounting bracket engages at least a portion of the sidewall of the second mounting channel to mount the shelf, and an entirety of the rear surface of the shelf is configured to be in surface contact with an outer surface of the wall.

2. The wall hanging system according to claim 1 wherein the first mounting bracket comprises a first extended portion that is configured to be spaced from the wall, wherein the second mounting bracket comprising a second extended portion that is configured to be spaced from the wall, wherein each of the first and second mounting channels comprises an undercut portion that is positioned behind an overhang portion, and wherein the first extended portion of the first mounting bracket nests within the undercut portion of the first mounting channel and the second extended portion of the second mounting bracket nests within the undercut portion of the second mounting channel.

3. The wall hanging system according to claim 2 wherein the first mounting channel extends along a first axis, the overhang portion of the first mounting channel terminating in an edge having a first arcuate portion located on a first side of the first axis and a second arcuate portion located on a second side of the first axis.

4. The wall hanging system according to claim 3 wherein the first mounting bracket comprises an anterior portion that comprises the front surface and a front portion of a peripheral edge of the first mounting bracket and a posterior portion that comprises the rear surface and a rear portion of the peripheral edge of the first mounting bracket, and wherein when the first mounting bracket nests within the first mounting channel of the shelf, at least a portion of the anterior portion of the first mounting bracket nests within the undercut portion of the first mounting channel and at least a portion of the edge of the overhang portion of the first mounting channel is in abutting contact with at least a portion of the rear portion of the peripheral edge of the first mounting bracket, the rear portion of the peripheral edge of the first mounting bracket comprising arcuate portions that mate with the first and second arcuate portions of the edge of the overhang portion of the first mounting channel.

5. The wall hanging system according to claim 2 wherein the first extended portion is U-shaped and nests within the undercut portion of the first mounting channel and the second extended portion is U-shaped and nests within the undercut portion of the second mounting channel to prevent a pulling force acting on the shelf in a direction perpendicular to the rear surface of the shelf from detaching the shelf from the first and second mounting brackets without first sliding the shelf upwardly relative to the first and second mounting brackets to remove the first extended portion of the first mounting bracket from the undercut portion of the first mounting channel and to remove the second extended portion of the second mounting bracket from the undercut portion of the second mounting channel.

6. The wall hanging system according to claim 1 wherein the first mounting channel extends along a first axis, the sidewall of the first mounting channel forming at least a first side boundary of the first mounting channel located on a first side of the first axis, a second side boundary of the first mounting channel located on a second side of the first axis, and a top boundary of the first mounting channel that is intersected by the first axis, and wherein the second mounting channel extends along a second axis, the sidewall forming at least a first side boundary of the second mounting channel located on a first side of the second axis, a second side boundary of the second mounting channel located on a second side of the second axis, and a top boundary of the first mounting channel that is intersected by the second axis.

7. The wall hanging system according to claim 1 wherein the first mounting channel comprises a first depth measured from the floor of the first mounting channel to the rear surface of the shelf, the second mounting channel comprises a second depth measured from the floor of the second mounting channel to the rear surface of the shelf, the first mounting bracket comprises a first thickness measured from the front surface of the first mounting bracket to the rear surface of the first mounting bracket, and the second mounting bracket comprises a second thickness measured from the front surface of the second mounting bracket to the rear surface of the second mounting bracket, the first depth being equal to or greater than the first thickness so that the rear surface of the first mounting bracket is flush with or recessed relative to the rear surface of the shelf when the first mounting bracket nests within the first mounting channel, and the second depth being equal to or greater than the second thickness so that the rear surface of the second mounting bracket is flush with or recessed relative to the rear surface of the shelf when the second mounting bracket nests within the second mounting channel.

8. The wall hanging system according to claim 1 wherein the first fastener comprises a first screw, and wherein the first mounting bracket is configured to be mounted to the wall by the first fastener such that a portion of the first fastener is located within the first mounting aperture, and wherein a diameter of the portion of the first fastener that is located within the first mounting aperture is less than a width of the first mounting aperture so that the first mounting bracket can move side-to-side relative to the first fastener.

9. The wall hanging system according to claim 1 wherein the shelf comprises the rear surface and a support portion protruding from the rear surface to a distal edge, the support portion comprising a planar top surface that protrudes horizontally from the rear surface to support items thereon.

10. The wall hanging system according to claim 1 wherein the first mounting aperture is the only mounting aperture formed into the first mounting bracket that is configured to receive a fastener configured for mounting the first mounting bracket to the wall.

11. The wall hanging system according to claim 1 wherein the first mounting channel comprises a lower section having a first width and an upper section having a second width, the first width being greater than the second width, and wherein the second mounting channel comprises a lower section having a third width and an upper section having a fourth width, the third width being greater than the third width.

12. The wall hanging system according to claim 11 wherein the first mounting channel comprises a first longitudinal axis, and wherein the sidewall of the first mounting channel comprises a first convex portion between the lower and upper sections on a first side of the longitudinal axis and a second convex portion between the lower and upper sections on a second side of the longitudinal axis, and wherein the second mounting channel comprises a second longitudinal axis, and wherein the sidewall of the second mounting channel comprises a third convex portion between the lower and upper sections on a first side of the second longitudinal axis and a fourth convex portion between the lower and upper sections on a second side of the second longitudinal axis.

13. The wall hanging system according to claim 11 wherein the first mounting bracket comprises a first extended portion that is configured to be spaced from the wall, the first extended portion being located along the upper section of the first mounting channel without extending along the lower portion of the first mounting channel when the shelf is mounted to the first mounting bracket, and wherein the second mounting bracket comprises a second extended portion that is configured to be spaced from the wall, the second extended portion being located along the upper section of the second mounting channel without extending along the lower portion of the second mounting channel when the shelf is mounted to the second mounting bracket.

14. The wall hanging system according to claim 1 wherein each of the first and second mounting brackets comprises:

a main body portion comprising a peripheral edge having a top portion, a first side portion, and a second side portion; and a flange portion extending perpendicularly from the peripheral edge of the main body portion, the flange portion being U-shaped and extending from the top portion and at least a portion of each of the first and second side portions of the main body portion.

15. A method of hanging a shelf from a wall, the method comprising:

positioning a rear surface of a first mounting bracket into abutment with the wall and inserting a first fastener through a first aperture in the first mounting bracket and into the wall to mount the first mounting bracket to the wall, wherein the first aperture of the first mounting bracket is elongated so that the first mounting bracket can move side-to-side along the wall while mounted to the wall by the first fastener;

positioning a rear surface of a second mounting bracket into abutment with the wall at a distance from the first mounting bracket and inserting a second fastener through a second aperture in the second mounting bracket and into the wall to mount the second mounting bracket to the wall, wherein the second mounting aperture is circular so that the second mounting bracket is fixed in place while mounted to the wall by the second fastener;

positioning a rear surface of the shelf into contact with the wall with a first mounting channel of the shelf aligned with the first mounting bracket and a second mounting channel of the shelf aligned with the second mounting bracket; and moving the shelf downwardly along the wall until the first mounting bracket nests within the first mounting channel and the second mounting bracket nests within the second mounting channel, thereby mounting the shelf to the wall, wherein during the moving of the shelf downwardly along the wall, the first mounting bracket is permitted to slide side-to-side along the wall relative to the first fastener to perfect an alignment between the first mounting bracket and the first mounting channel of the shelf; and wherein upon the shelf being mounted to the wall, the rear surface of the shelf is in surface contact with an outer surface of the wall.

16. The method according to claim 15 wherein, upon the shelf being mounted to the wall, the shelf is prevented from moving horizontally along the wall more than a de minimis amount due to interaction between at least one of the first mounting bracket and a wall that bounds the first mounting channel and the second mounting bracket and a wall that bounds the second mounting channel.

17. A wall hanging system comprising:

a wall décor item comprising a rear surface that is configured to face a wall on which the wall décor item is mountable, a first mounting channel and a second mounting channel formed into the rear surface of the wall décor item in a spaced apart manner;

a first mounting bracket comprising a first mounting aperture that receives a first fastener configured for mounting the first mounting bracket to the wall, wherein the first mounting aperture is elongated so that the first mounting bracket is configured to slide relative to the first fastener;

a second mounting bracket comprising a second mounting aperture that receives a second fastener configured for mounting the second mounting bracket to the wall, wherein the second mounting aperture is circular so that the second mounting bracket is configured to be in a fixed position on the wall; and wherein the wall décor item is configured to be mounted to the wall by engagement between the first mounting bracket and the first mounting channel and engagement between the second mounting bracket and the second mounting channel.

18. The wall hanging system according to claim 17 wherein the first mounting bracket comprises a first lateral side and a second lateral side, the first mounting aperture being elongated in a direction between the first and second lateral sides of the first mounting bracket, and wherein the first mounting aperture is the only mounting aperture formed into the first mounting bracket that is configured to receive a fastener configured for mounting the first mounting bracket to the wall.

19. The wall hanging system according to claim 17 wherein each of the first and second mounting brackets comprises:

a main body portion comprising a peripheral edge having a top portion, a first side portion, and a second side portion; and a flange portion extending perpendicularly from the peripheral edge of the main body portion, the flange portion being U-shaped and extending from the top portion and at least a portion of each of the first and second side portions of the main body portion.

20. The wall hanging system according to claim 19 wherein a lower portion of the peripheral edge of the main body portion is flush with a peripheral edge of the flange portion.

* * * * *